US008979426B2

(12) United States Patent
Doig

(10) Patent No.: US 8,979,426 B2
(45) Date of Patent: Mar. 17, 2015

(54) BOAT LIFT APPARATUS

(76) Inventor: Daniel Doig, Innisfil (CA)

( * ) Notice: Subject to any disclaimer, the term of this patent is extended or adjusted under 35 U.S.C. 154(b) by 331 days.

(21) Appl. No.: 13/396,476

(22) Filed: Feb. 14, 2012

(65) Prior Publication Data

US 2013/0004238 A1 Jan. 3, 2013

Related U.S. Application Data

(60) Provisional application No. 61/442,480, filed on Feb. 14, 2011.

(51) Int. Cl.
*B63C 3/12* (2006.01)
*B63C 3/06* (2006.01)

(52) U.S. Cl.
CPC ..... *B63C 3/06* (2013.01)
USPC ..... 405/3; 114/44

(58) Field of Classification Search
CPC ..... B60P 3/10; B63B 2737/00
USPC ..... 405/1, 3, 7; 114/44, 48, 51
See application file for complete search history.

(56) References Cited

U.S. PATENT DOCUMENTS

| | | | | |
|---|---|---|---|---|
| 4,864,951 | A * | 9/1989 | Koepp, Jr. | 114/44 |
| 5,890,835 | A * | 4/1999 | Basta et al. | 405/3 |
| 6,575,661 | B1 * | 6/2003 | Phillips et al. | 405/3 |
| 6,823,809 | B2 * | 11/2004 | Hey | 114/45 |
| 6,830,002 | B1 * | 12/2004 | Walker | 114/44 |
| 2011/0041754 | A1 * | 2/2011 | Grabe et al. | 114/312 |

* cited by examiner

*Primary Examiner* — Sean Andrish
(74) *Attorney, Agent, or Firm* — Stuart L. Wilkinson

(57) ABSTRACT

A boat lift apparatus includes a base having a first base beam and a second base beam and a moveable boat support platform having a first lifting beam, a second lifting beam, and at least one cradle support connected to and suspended between the first and second lifting beams. At least two first support struts connect the first base beam and the first lifting beam, and at least two second support struts connect the second base beam and the second lifting beam. When the boat support platform is in a lowered position the at least two first support struts are generally parallel to both the first base beam and the first lifting beam, and the at least two second support struts are generally parallel to both the second base beam and the second lifting beam.

23 Claims, 17 Drawing Sheets

BOAT LIFT APPARATUS

FIELD

The teaching disclosed in this specification relates to one or more methods or apparatuses for raising a boat (or other type of watercraft) from a floating position to a raised position above the water.

BACKGROUND

U.S. Pat. No. 6,830,002 (Walker) discloses a lift for watercraft that has a raised and lowered positions and is adapted to be mounted in a body of water. The lift has a substantially rectangular base with first and second pairs of vertical corner posts that are connected to and carry longitudinal beams. The base further has two transverse beams connected to the longitudinal beams. A pivoting cradle is attached to the base. Watercraft support bunks are connected to the cradle. A pair of actuators are connected on one end to the pivoting cradle and on the other end to one of the first pair of corner posts. The first pair of corner posts are adapted to be long enough that at least a portion of the corner posts are above water level of a body of water in which the lift is mounted, and the actuators are connected to the first pair of corner posts in the portion of the corner posts above the water level.

U.S. Pat. No. 5,908,264 (Hey) discloses a watercraft lift having raised and lowered positions. The lift includes a substantially rectangular base with longitudinal side beams and front, rear, and intermediate transverse beams, connected to the longitudinal beams. The intermediate transverse beam is located between the front and rear transverse beams and at a height lower than the front and rear transverse beams. Forward booms are pivotably connected to the base at a location near the front transverse beam. Rear booms are pivotably connected to the base at a location near the intermediate transverse beam. A watercraft support platform is pivotally connected to the forward and rear booms. The raising and lowering of the lift of the present invention is accomplished by an actuation assembly. In a preferred embodiments, the actuation assembly includes two dual directional high pressure hydraulic cylinders pivotally connected between the intermediate transverse beam and the rear boom. During use, the actuator assembly rotates the booms upward and forward about their pivotable connection to the base further raising the watercraft support platform and the watercraft to an over-center position.

U.S. Pat. No. 5,184,914 (Basta) discloses upwardly extending pivoting booms are supported on a rectangular base which is submerged in water. Watercraft supports on mounting arms are connected to the pivoting booms. A double-acting hydraulic cylinder attached between the rectangular base and pivoting booms swings the pivoting booms upwardly until they are braced by boom supports on the rectangular base at an angle over center. This raising of the pivoting booms lifts the mounting arms and watercraft supports to remove a craft from the water and disposes the booms, mounting arms, and craft in a stable, secure over center configuration. Actuation of the double-acting hydraulic cylinder in the opposite direction forces the booms back out of the over center position and lowers the craft into the water.

U.S. Pat. No. 5,890,835 (Basta et al.) discloses a hydraulic lift for raising a boat out of water into a raised storage position is proposed. Pivoting booms are connected to a frame that is supportable by a bed of a body of water. A boat rack is provided at an upper portion of the pivoting booms. A hydraulic cylinder is connected between the frame and a lower portion of the pivoting booms. The pivoting booms are selectively adjustable between a lowered position wherein the rack is submerged in the water and a raised storage position wherein the rack is raised above the water. The position of the pivoting booms is controlled by a ram of the hydraulic cylinder. Importantly, the pivoting booms are maintained in the raised storage position when the ram is in a retracted position which protects the ram from corrosion and fouling. In the preferred embodiment, the pivoting booms are rotated over center when they are in the raised storage position.

U.S. Pat. No. 6,830,410 (Davidson et al.) discloses an apparatus for supporting the hull of a watercraft using a flexible bunk beam and a convex cushion attached to the beam using locking elements. The beam has a longitudinal recess with a narrow upper neck portion and a larger lower anchor portion, and the cushion has an elongated cushion locking member lockably insertable into the recess. The cushion locking member has a narrow upper neck portion and a larger lower portion sized to snuggly fit within the recess. The cushion includes internal voids and walls. The beam includes sidewalls with bores forming bearing surfaces.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

According to one broad aspect of the invention, a boat lift apparatus can include a base comprising a support surface to rest on the bottom of a body of water. The base can include a first base beam and a second base beam. The second base beam can be oriented generally parallel to and spaced laterally apart from the first base beam. The boat lift can also include a boat support platform having a first lifting beam aligned with the first base beam, a second lifting beam aligned with the second base beam, and at least one cradle support connected to and suspended between the first and second lifting beams. The boat support platform can be moveable relative to the base between a lowered position for receiving a boat and a raised position for lifting the boat out of the water. The boat lift can also include at least two first support struts connecting the first base beam and the first lifting beam. Each first support strut includes a lower end pivotally connected to the first base beam and an opposing upper end pivotally connected to the first lifting beam. The boat lift also includes at least two second support struts connecting the second base beam and the second lifting beam. Each second support strut includes a lower end pivotally connected to the second base beam and an opposing upper end pivotally connected to the second lifting beam. When the boat support platform is in the lowered position the at least two first support struts are oriented generally parallel to both the first base beam and the first lifting beam, and the at least two second support struts are oriented generally parallel with both the second base beam and the second lifting beam.

When the boat support platform is in the raised position the at least two first support struts can be parallel to each other and can be generally perpendicular to both the first base beam and the first lifting beam.

When the boat support platform is in the lowered position the first support struts can overlie at least a portion of the first base beam and the first lifting beam can overlie at least a portion of the first support struts.

Each of the first support struts may include a first bearing surface and an opposing second bearing surface. When the boat platform is in the lowered position a downward facing surface of the first lifting beam may bear against each first bearing surface, and the second bearing surfaces may bear against an upward facing surface on the first base beam.

The at least one cradle support may include a lift in surface. When the boat support platform is in the lowered position the lift in surface can be at a lowered height and when the boat support platform is in the raised position the lift in surface can be at a raised height. A lift ratio between the raised height and the lowered height may be greater than 8:1.

When the boat support platform is in the lowered position the lift in surface may be less than 10 inches above the support surface.

Each first support strut may include a strut axis, and when the boat support platform is in the lowered position the strut axes of the first support struts may be coaxial with each other.

The boat lift can also include a first actuator connected between at least one of the first support struts and the first base beam to pivot the at least one of the first support struts relative to the first base beam, and a second actuator connected between at least one of the second support struts and the second base beam to pivot the at least one of the second support struts relative to the second base beam.

The first base beam may include an inboard base rail and an opposing outboard base rail. The outer base rail may be laterally spaced apart from and generally parallel to the inner base rail, and a first end of the first actuator may be disposed between the inner and outer base rails and may be pivotally connected to at least one of the inner and outer base rails.

The at least two first support struts may include an inboard support arm pivotally connected to the inboard base rail, and an outboard support arm pivotally connected to the outboard base rail. The outboard support arm may be generally parallel to the inboard support arm, and a second end of the first actuator may be disposed between, and pivotally connected to, at least one of the inboard and outboard support arms.

The first actuator and second actuator may be positioned on opposite sides of the at least one cradle support, and may be outboard from the at least one cradle support.

When the boat support platform is in the lowered position, a lift clearance distance between an upper surface of the lifting beams and the support surface may be between 100% and 150% of the sum of the thickness of one lifting beam, one support strut and one base beam.

The boat lift can also include a plurality of bunk assemblies supported on the at least one cradle support and at least a portion of the bunk assemblies can be moveably connected to the at least one cradle support so that the lateral position of the at least some of the bunk assemblies can be adjustable relative to the cradle support.

The first lifting beam may be parallel to the first base beam when the boat support platform is in the raised position, when the boat support platform is in the lowered position and when the boat support platform is in an intermediate position between the raised and lowered positions.

Each of the first support arms and second support struts may be of variable length and may be securable in a retracted configuration and an extended configuration.

The lowered height of the boat support platform may be the same when the first and second support arms are in either the retracted or extended configurations.

The boat lift can also include a plurality of support legs for supporting the base above the bottom of the body of water. The plurality of support legs may include a plurality of first support legs connected to the first base beam, and a plurality of second support legs connected to the second base beam. The plurality of first legs may include at least one inboard support leg, positioned laterally between first base beam and the second base beam, and at least one outboard support leg, positioned outboard of the first base beam.

The at least one inboard support leg may at least partially underlie the boat support platform.

The distance between an outboard surface of the first base beam and an outboard surface of the second base beam may define a base width, and the at least one outboard support leg may be laterally spaced apart from an outboard surface of the first base beam by a leg offset distance that is less than 30% of the base width.

At least one of the base and the boat support platform may also include a chamber for containing a gas that is less dense than water.

According to another broad aspect of the invention, a boat lift apparatus may include a base configured to rest on the bottom of a body of water and a boat support movably connected to the base. The boat support may be configured to support a boat and may be movable between a lowered position, to receive a boat, and a raised position, to lift the boat out of the water. At least one of the base and the boat support may include at least one first gas-trapping chamber for containing a gas that is less dense than water so that gas within the chamber can exert a lifting force when the at least one of the base and the boat support is submerged under water.

The boat lift can also include a first gas fitting having an inlet that is connectable to a gas supply and an outlet that is in fluid communication with at least one first gas-trapping chamber. The gas fitting can be to regulate the flow of gas into the at least one first gas-trapping chamber.

The boat lift can also include a first water passage in a downward facing surface of the at least one of the base or boat support. The first water passage can have a first end in communication with the body of water and a second end in fluid communication with the at least one first gas-trapping chamber to allow water to flow out of the first gas-trapping chamber as the gas flows into the first gas-trapping chamber.

The base may include a first base beam and a second base beam oriented generally parallel to and laterally spaced apart from the first base beam, and the at least one first gas-trapping chamber may include at least one first gas-trapping chamber in each base beam.

The boat support may include at least one second gas-trapping chamber.

The boat support may include a first lifting beam oriented generally parallel to the first base beam and a second lifting beam oriented generally parallel to the second lifting beam. The at least one second gas-trapping chamber may include at least one second gas-trapping chamber in each lifting beam.

The boat lift can also include a plurality of cradle supports suspended between the first and second lifting beams. Each cradle beam may have a sealed internal gas chamber containing the gas.

DRAWINGS

For a better understanding of the applicant's teachings described herein, reference will now be made, by way of example only, to the accompanying drawings in which:

FIG. 1 is a perspective view of a boat lift in the raised position;

FIG. 2*a* is a side elevation view of the boat lift of FIG. 1;

FIG. 2*b* is a side elevation view of the boat lift of FIG. 1, in which support struts in a retracted position;

FIG. 3 is an end view of the boat lift of FIG. 1;

FIG. 4*a* is a side elevation of the boat lift of FIG. 1 in a lowered position;

FIG. 4*b* is an enlarged view of a portion of FIG. 4*a;*

FIG. 4*c* is similar to the view of FIG. 4*a*, but showing the support struts in a contracted position;

DETAILED DESCRIPTION

Various apparatuses or processes will be described below to provide an example of an embodiment of each claimed invention. No embodiment described below limits any claimed invention and any claimed invention may cover processes or apparatuses that are different from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Figure 1:
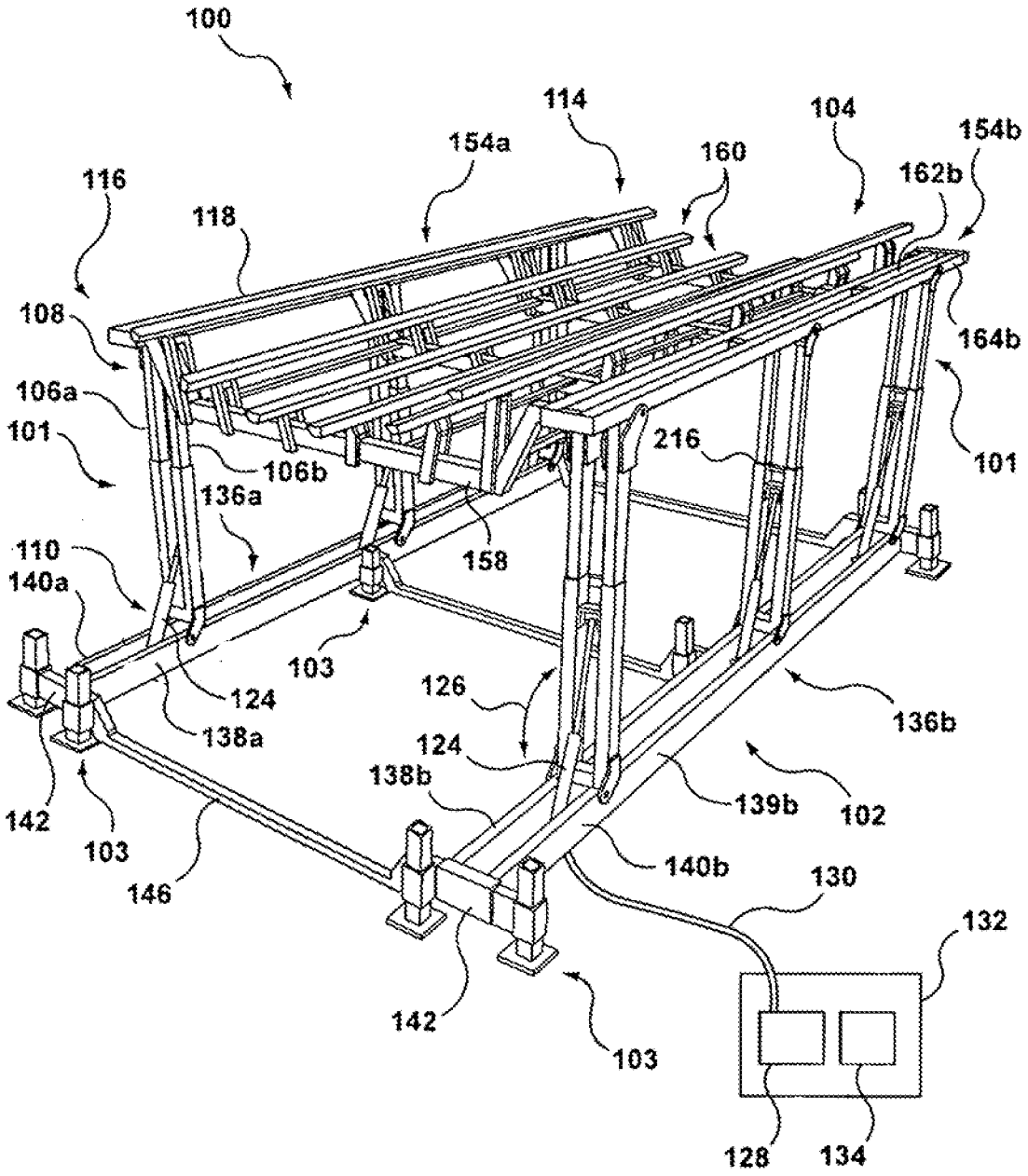

Referring to FIG. 1, an example of a boat lift 100 includes a base 102, and a boat support platform 104 that is movably connected to the base 102. In the illustrated example, the boat support platform 104 is connected to the base 102 by a plurality of support struts 101. The base 102 is configured to rest on the bottom of a body of water, such as a lake, ocean or river. Each support strut 101 has a lower end 110 that is pivotally connected to the base 102 and an upper end 108 that is spaced apart from the lower end 110. The upper end 108 is pivotally connected to the boat support platform 104. In this configuration, the boat support platform 104 is moveable between a raised position (FIGS. 1-3) and a lowered position (FIGS. 4*a* and 5).

Figure 2A:
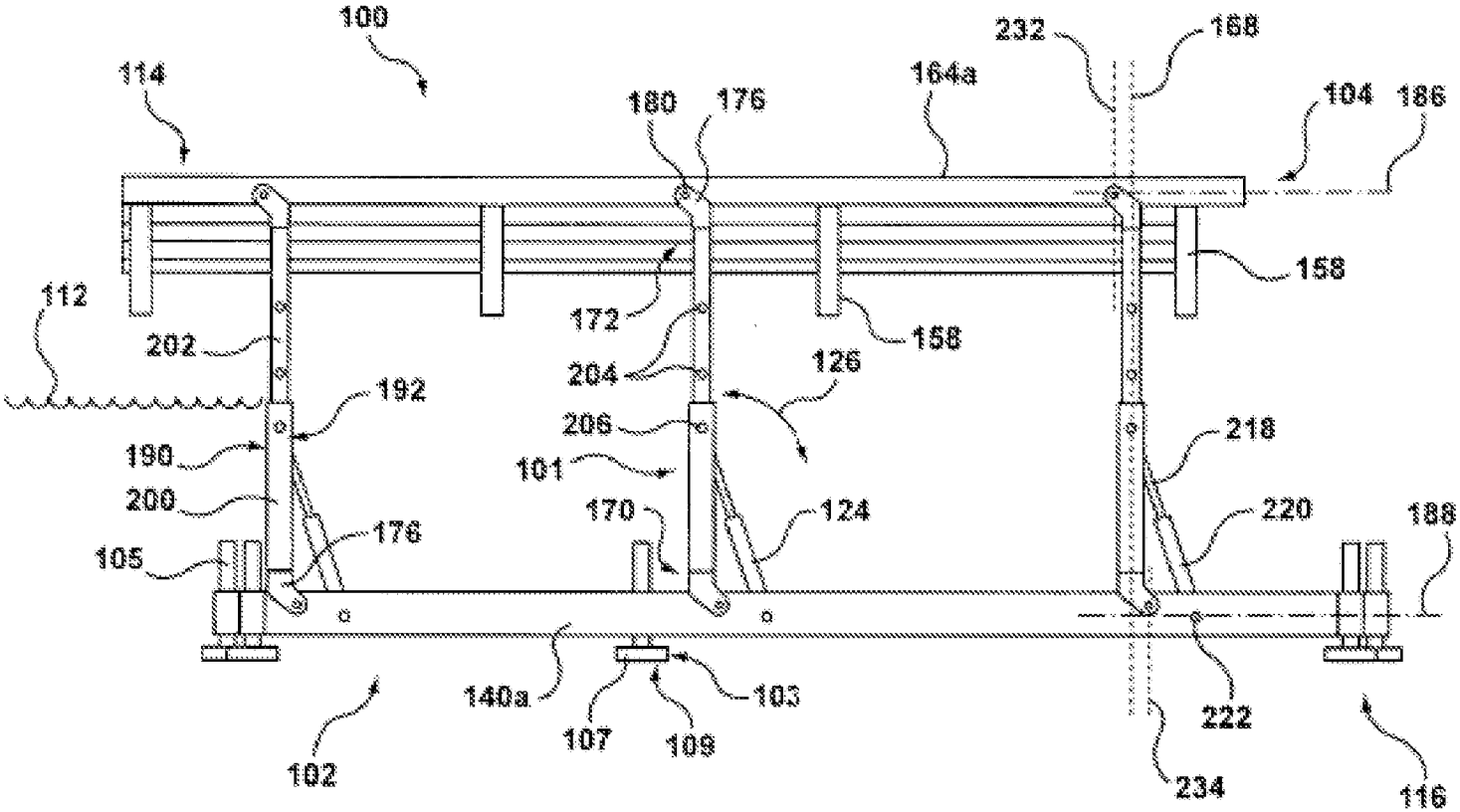
Figure 5:
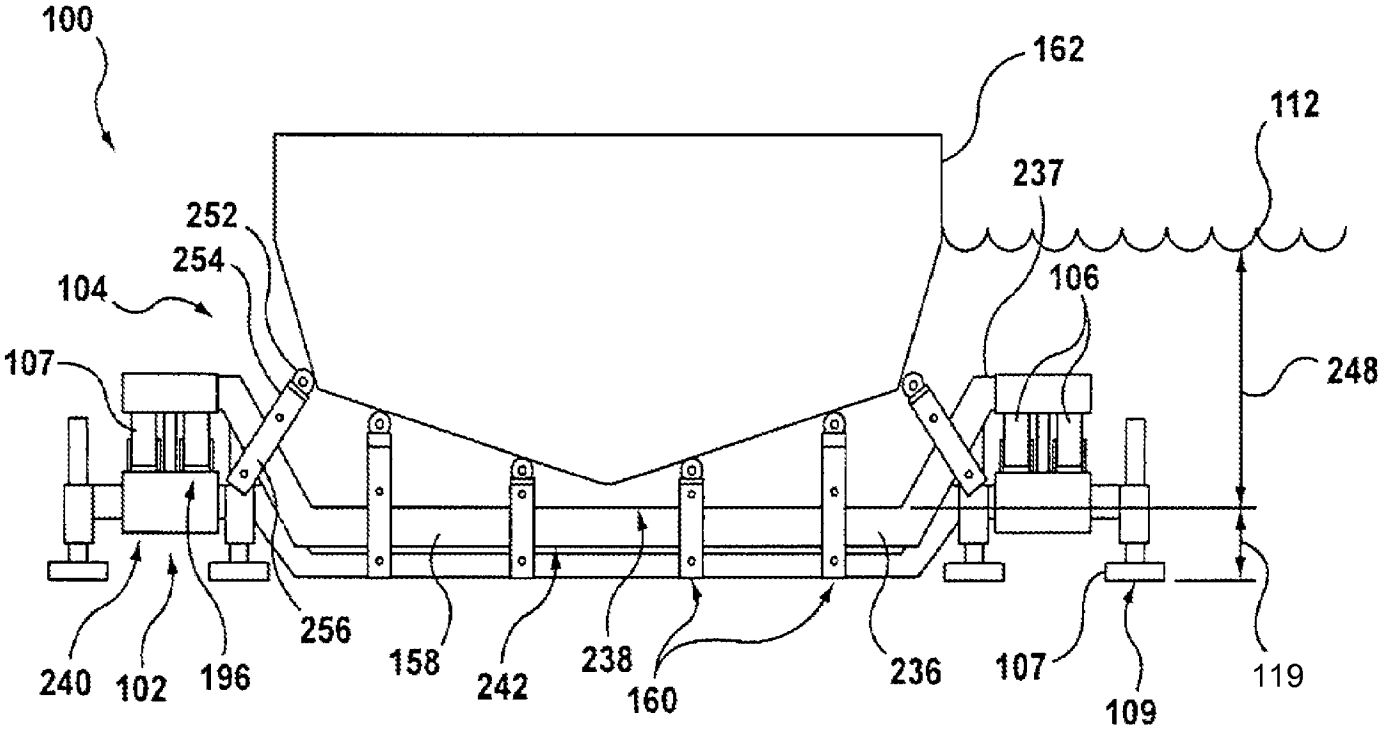
FIG. 5 is a front end view of a hull portion of a boat supported the boat lift of FIG. 1 in a lowered position.

Referring to FIG. 5, in the lowered position, the boat support platform 104 is below the surface of the water, represented by line 112, providing sufficient draft so that a boat can generally be moved under its own power onto or off of the support platform 104 when in the lowered position. Referring to FIG. 2*a*, in the raised position, the boat support platform 104 is lifted above the surface of the water 112 so that the boat is supported above the water for storage.

Figure 3:
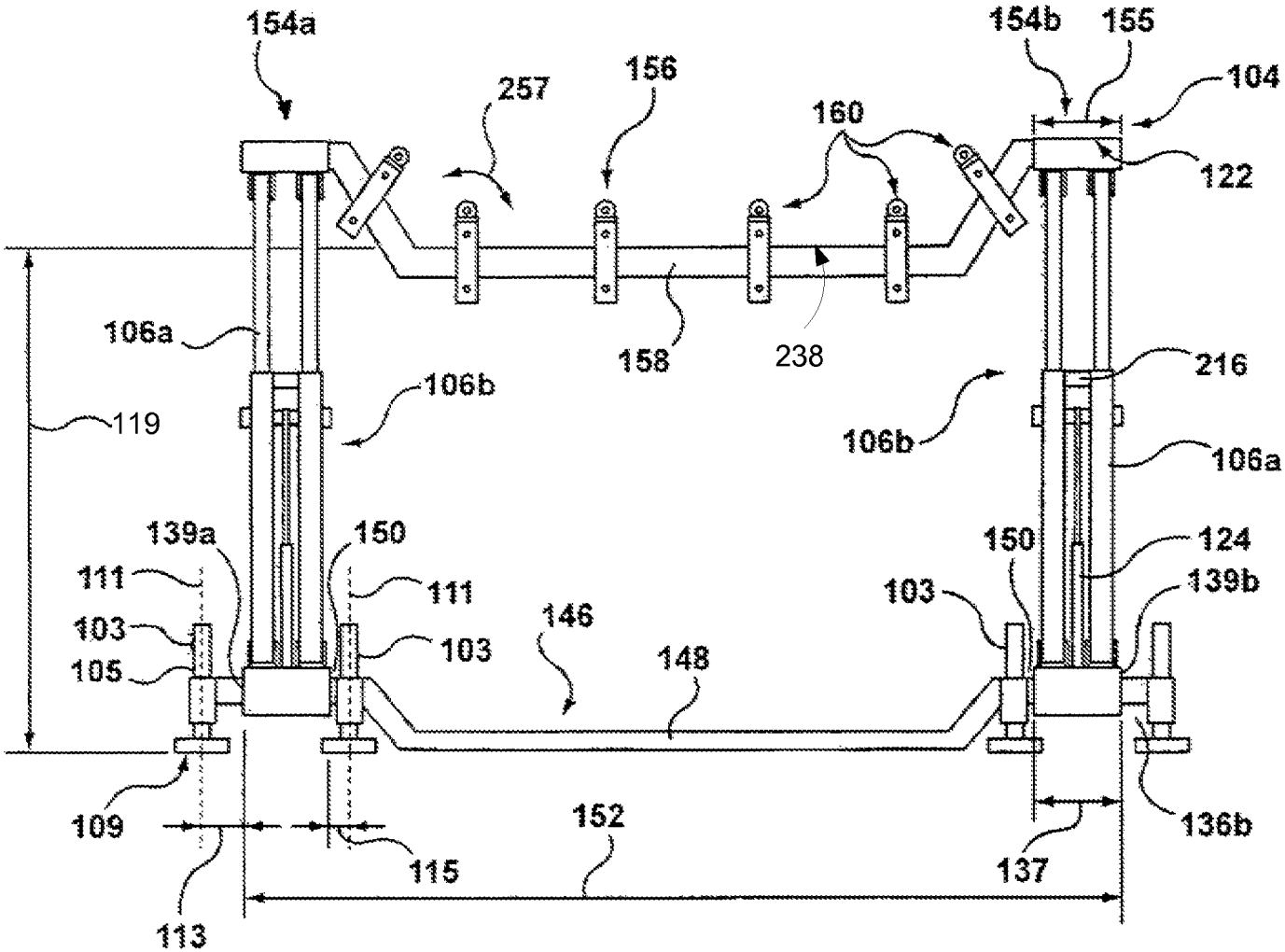
Figure 4A:
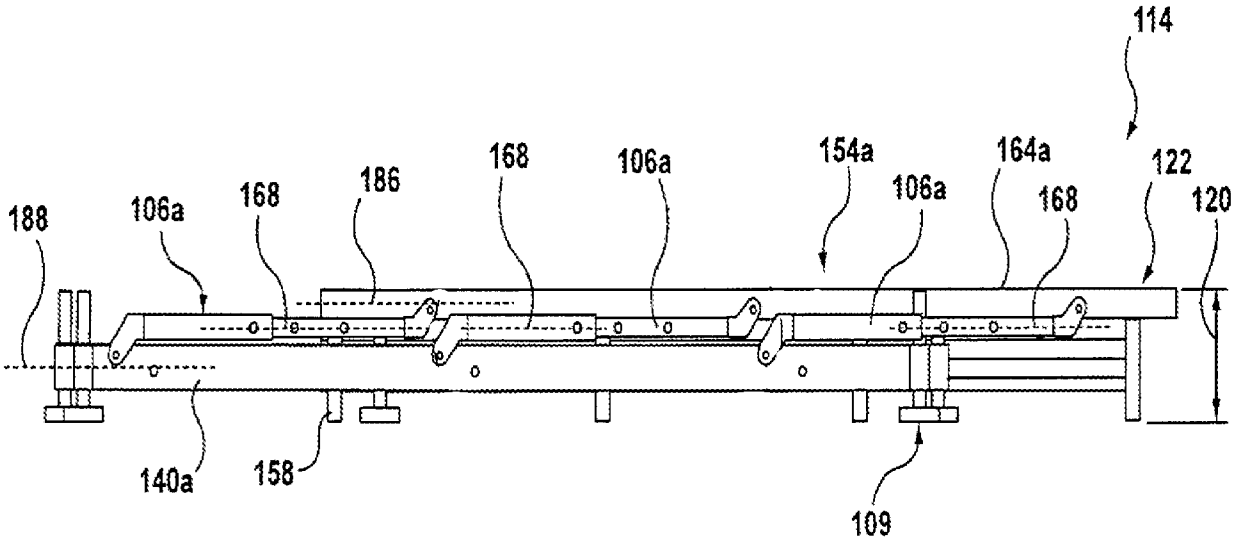

Referring to FIGS. 3 and 5, for the purposes of this description, the height of the boat lift 100 is the distance between a first reference surface on the boat support platform 104, for example the lift in surfaces 238 of cradle supports 158 (described in detail below), and a second reference surface on the base 102, for example the support surfaces 109 of the support legs 103. The ratio between the height 118 of the boat support platform in its raised position (its raised height, FIG. 3) compared to the height 119 of the boat support platform in its lowered position (its lowered or lift-in height, FIG. 5) defines a lift ratio. As explained in greater detail below, in the illustrated example the lift ratio (i.e. raised height 118: lowered height 119) of the boat lift 100 can be between approximately 5:1 and 15:1, and optionally can be between 8:1 and 14:1.

Referring again to FIG. 1, the boat lift 100 includes a first end 114 an opposing second end 116. When moved from the raised position to the lowered position, the boat support platform 104 is in the lowered position it is generally level and, having both ends 114, 116 of the platform open, is able to receive a boat from either direction.

The boat lift 100 also includes at least one actuator 124, and preferably at least one actuator 124 per side, for moving the boat support platform 104 between its raised and lowered positions. In the illustrated example, the boat lift 100 includes one hydraulic actuator 124 connected between each support strut 101 and the base 102, to pivot the support struts 101 relative to the base 102 in the direction indicated using arrow 126. In the illustrated example, when the boat support platform is in the lowered position, the actuators 124 are in a retracted position. The actuators 124 can comprise a piston/cylinder arrangement connected to a pressurized fluid supply source. Alternatively, the actuators 124 can comprise electric actuators, such as a ball screw and nut arrangement. In the example illustrated, the actuators 124 are in the form of pistons slidably mounted in respective cylinders and connected to a source 128 of pressurized hydraulic fluid (which may include a hydraulic pump driven by an electric motor, a gasoline or diesel motor or other suitable power source) by conduits 130. While only a single conduit 130 is illustrated for clarity, each actuator 124 can be connected to the hydraulic supply source. The conduits 130 can contain splitters, flow regulators, valves and other hardware that can be used to route hydraulic fluid to all of the actuators 124. Optionally, the hydraulic supply source 128 can include more than one pump/motor combination, to provide redundancy in the event that one of the pump/motor combinations should fail. Each pump/motor combination can be sized so that it is independently capable of moving a loaded boat support platform 104. Optionally, the hydraulic supply source 128 can be located in a remote utility box 132 that is positioned out of the water, for example on shore or on a dock. The utility box 132 can also include a power supply 134, including, for example a battery and/or a solar panel, for providing power to drive the hydraulic supply source. The power supply 134 can also provide power to other devices and accessories that may be mounted on, or used in combination with the lift 100, including for example, lights.

To lift the boat support platform 104 (and any boat thereon) into the raised position, the actuators 124 are moved to the extended positions, thereby pivoting the support struts 101 into their upright positions (see for example FIG. 1).

Referring still to FIG. 1, the base 102 includes two spaced apart base beams 136*a*, 136*b* that are generally parallel to each other and extend in a longitudinal direction. In the illustrated example, each base beam 136*a*, 136*b* is formed from an inboard base rail member 138*a*, 138*b* and an outboard base rail member 140*a*, 140*b*. Each base beam 136*a*, 136*b* has a laterally outboard face 139*a*, 139*b*, respectively, facing away from the opposed beam 136*b*, 136*a*. The opposing rail members 138*a*, 140*a* and 138*b*, 140*b* in each beam 136*a* and 136*b*, respectively, are connected together using end plates 142. Optionally, the end plates 142 can be permanently connected to the base rails, for example by welding, so that the assembled base beams 136*a*, 136*b* cannot be easily disassembled. Alternatively, the base plates 142 can be detachably connectable to at least one of the base rail members 138, 140, for example using bolts or pins, so that base support rails 138, 140 can be detached from each other for transportation and then assembled on site.

Referring to FIG. 3, the distance between the outboard faces 139*a*, 139*b* of the base beams 136*a* and 136*b* respectively, when assembled as shown, defines a base width 152. The base width 152 can generally be in the range of about eight feet to about thirty feet. In the example illustrated, the base width 152 is about fourteen feet. Increasing the base width 152 may help increase the lateral stability of the boat lift 100. The width 152 of the base, and the corresponding length of the cross members 146, can be selected based on a plurality of factors, including the expected load to be carried by the boat lift, the elevation of the boat support platform in the raised position and the condition and/or composition of the bottom of the body of water (for example sand, rocks, gravel, silt, etc.).

Referring again to FIGS. 1, 2*a* and 3, the lift 100 includes a support surface for resting on the bottom of the lake/ocean. In the illustrated example, the base 102 is supported on a ten height-adjustable support legs 103 that can rest on the bottom of the lake, river or ocean. Each support leg 103 includes an extension member 105 that can be movably connected to the base 102, and a generally planar foot plate 107 having a support surface 109 for contacting the bottom of the body of water. Each support leg 103 can be fixed in a given extension position using a locking pin, or other suitable locking mechanism. Each support leg 103 is independently moveable relative to base 102 and the plurality of support legs 103 can be independently adjusted so that the base 102 is supported in a generally level orientation even if the bottom of the body of water is uneven, or slopes away from the shore. Each support leg 103 defines a support leg axis 111, which in the illustrated example is the central axis of the extension member 105.

The support legs 103 on the boat lift 100 are positioned so that each base beam 136*a*, 136*b* is supported by multiple support legs 103. Referring to FIG. 3, in the illustrated example, each base beam 136*a*, 136*b* is supported by at least one outboard support leg 103, located laterally outboard of the outboard faces 139*a*, 139*b* of base beams 136*a*, 136*b*, respectively, and at least one inboard support leg 103, located laterally inboard of each base beam 136*a*, 136*b*. In this configuration, the inboard support legs 103 are positioned beneath the boat support platform 104 and laterally between the base beams 136*a*, 136*b*.

Providing outboard support legs 103 may help further increase the stability of the boat lift 100. Increasing the outboard leg offset distance 113, the distance between the outboard faces 139*a* base beam 136*a*, and the outboard support leg axis 111, may help increase stability of the lift 100 but will also increase the overall width of the boat lift 100, which may limit the locations in which the lift 100 can be installed. Preferably, the outboard leg offset distance 113 is selected to be between approximately 0-30% of the base width 152, and optionally is selected to be less than 20% or less than 15% of the base width 152.

Providing inboard support legs 103 may help distribute the load exerted on the base beams 136*a*, 136*b*, and may help prevent the base 102 from bowing or deflecting inward when loaded. Preferably, the inboard support legs 103 are positioned close to the inboard surfaces of the base beams 136*a*, 136*b*, so that the extension members 105 of the inboard support legs 103 do not hit the hull of a boat on the lift, when the boat lift platform 104 is in the lowered position. Optionally, the inboard leg offset distance 115 can be selected based on the width of the boat that is to be placed on the lift. Alternatively, or in addition, the inboard leg offset distance 115 can be selected based on the lift width 152, so that the inboard leg offset distance 115 is between approximately 0-30% of the base width 152. The inboard leg offset distance 115 can be the same as, or different than the outboard leg offset distance 113.

Optionally, the inboard and outboard leg offset distances 115, 113 can be selected so that they are each less than the width 137 of the base beams 136*a*, 136*b*.

Optionally, the boat lift 100 can include more than ten legs 103 or fewer than ten legs. For clarity, some of the support legs 103 have been omitted in some of the Figures in this application.

Figure 6:
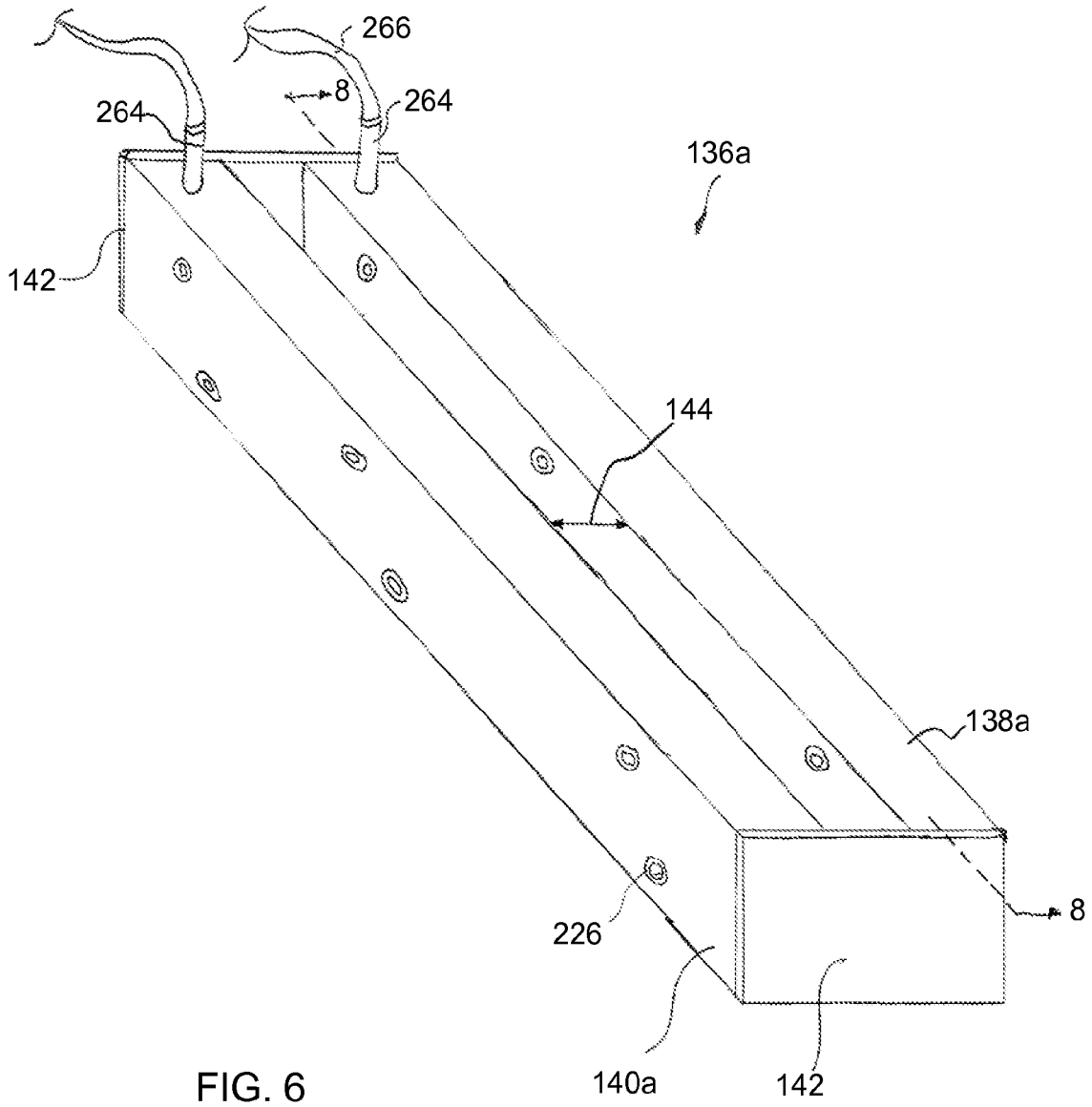
FIG. 6 is a perspective view of a base beam portion of the boat lift of FIG. 1.
Figure 7:
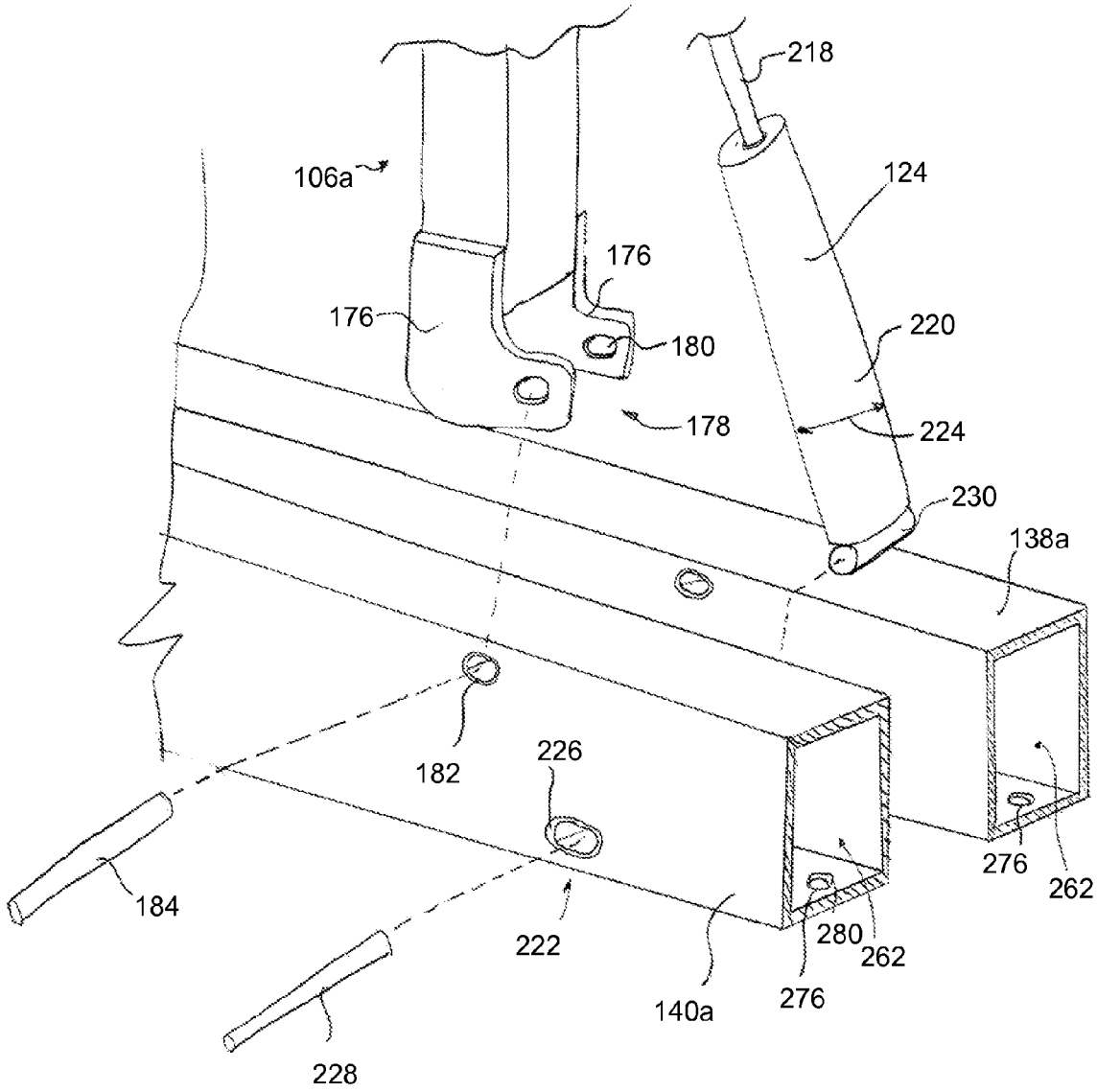
FIG. 7 is an exploded reverse perspective view of a portion of the boat lift of FIG. 1, with the base beam portion shown in a section view taken along line 7-7 in FIG. 6.

Referring to FIG. 6, an example of base beam 136*a* is shown in isolation, with other components of the lift 100 removed. The inboard and outboard base rails 138*a*, 140*a* are generally parallel to each other and are separated by a rail spacing distance 144. Referring also to FIG. 7, the base beam rails 138*a*, 140*a* are, in the illustrated example, formed from hollow, extruded aluminum tubes that have generally rectangular cross sections. Referring to FIG. 5, the width 137 of the base beam 136*a* can be between approximately seven and twenty-four inches, and in the example illustrated is approximately twelve inches.

Referring again to FIGS. 1 and 2*a*, the base beams 136*a*, 136*b* are connected to each other by a plurality of laterally extending cross members 146. The cross members 146 are spaced apart from each other along the length of the base beams 136*a*, 136*b*, and are generally orthogonal to the beams 136*a*, 136*b*. The cross members 146 are hollow, tubular members and are connected to the inboard rail 138*a*, 138*b* of each base beam 136*a*, 136*b*. The cross members 146 can help keep the base beams 136*a*, 136*b* generally parallel to each other. The cross members 146 are generally U-shaped, so that the central portion 148 of the cross members 146 is at a lower elevation than the ends 150 that are connected to the inboard rails 138*a*, 138*b*. Providing the central portion 148 at a lower elevation than the ends 150 may help prevent interference between the cross members 146 and the boat support platform 104, when the boat support platform 104 is in the lowered position. Optionally, the cross members 146 can be detachably connected to the base beams 136*a*, 136*b*, for example using bolts or pins. In some examples, the cross members 146 can be detached to facilitate transport of the boat lift 100.

Referring also to FIGS. 3 and 5, the boat support platform 104 includes a pair of lifting beams 154*a*, 154*b* and a cradle 156 suspended between the lifting beams 154*a*, 154*b*. Each lifting beam 154*a*, 154*b* in the boat support platform 104 is positioned vertically above, and is aligned with a corresponding base beam 136*a*, 136*b*. In the illustrated example, the upper surfaces 122 of the lifting beams 154*a*, 154*b* are generally flat, planar surfaces that can serve as walkways to allow a user to walk on the boat support platform 104, beside a boat that is resting on the platform 104.

The cradle 156 includes at least one lateral cradle support 158. In the illustrated example, the cradle 156 includes four laterally extending cradle supports 158 that are spaced apart from each other along the length of the boat support platform 104 and are connected to lifting beams 154*a*, 154*b*. The cradle 156 also includes a plurality of longitudinally extending bunk assemblies 160 for contacting and supporting the hull of the boat 162 on the lift (see FIG. 5). Optionally, the cradle supports 158 are detachably connected to the lifting beams 154*a*, 154*b* and the bunk assemblies 160 are detachably connected to the cradle supports 156. In some examples, the boat support platform 104 can be shipped to a user as a plurality of separate pieces, and then assembled on site.

Figure 9:
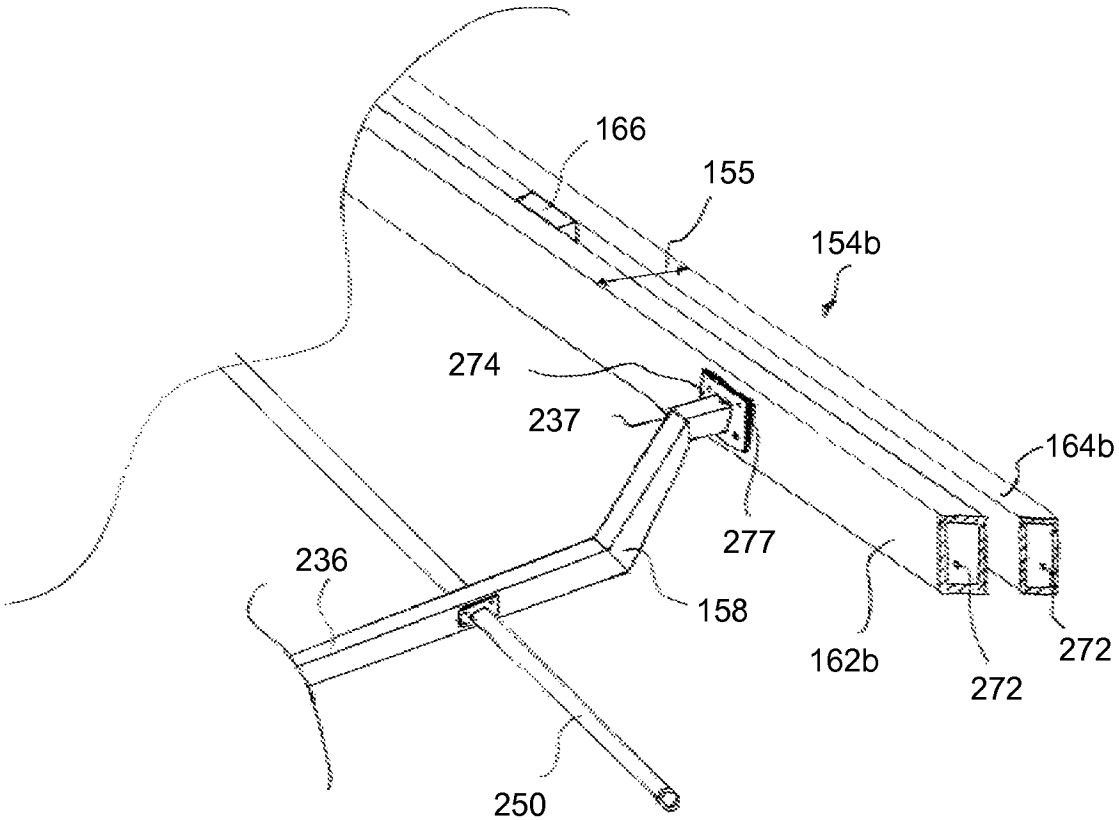
FIG. 9 is an enlarged perspective view of a boat support platform portion of the boat lift of FIG. 1.

Referring also to FIG. 9, in the illustrated example, the lifting beams 154*a*, 154*b* are each formed from an inboard lifting rail 162*a* and 162*b* and an outboard lifting rail 164*a* and 164*b*, respectively. Adjacent lifting rails 162*a*, 164*a* and 162*b*, 164*b* are connected to each other by a plurality of cross-link members 166. In this example, the lifting beams 154*a*, 154*b* are positioned so that the outboard and inboard rails of each lifting beam 162*a*, 162*b*, 164*a*, 164*b* are aligned with the respective outboard and inboard rails 138*a*, 138*b*, 140*a*, 140*b* of the corresponding base beams 136*a*, 136*b*.

Referring again to FIGS. 1 and 3, in the illustrated example, each support strut 101 comprises an outboard support arm, for example support arm 106*a* that connects outboard lifting rails 164*a* and 164*b* to corresponding base rails 140*a* and 140*b*, respectively. Each support strut 101 also includes an inboard support arm, for example support arm 106*b* that is offset from and is generally parallel with the outboard support arm 106*a*. The inboard support arms 106 connects inboard lifting rails 162*a* and 162*b* to corresponding base rails 138*a* and 138*b*, respectively. The support arms 106*a* and 106*b* in each support strut 101 are, in the example illustrated, connected to each other using at least one cross brace 216. Connecting the support arms 106*a* and 106*b* in each support strut 101 can help to provide unison of movement of the arms 106*a*, 106*b* in each strut 101 when moving between the raised and lowered positions. At least one of the support arms 106 and 106*b* in each strut 101 is pivotally connected to the upper end of a respective hydraulic actuator 124.

For simplicity, the connection between one representative outboard base rail 140*a* and one outboard lifting rail 164*a* will be described in detail in this description, but it is understood that the other pairs corresponding lifting and base rails are connected to each other in the same manner.

Figure 4B:
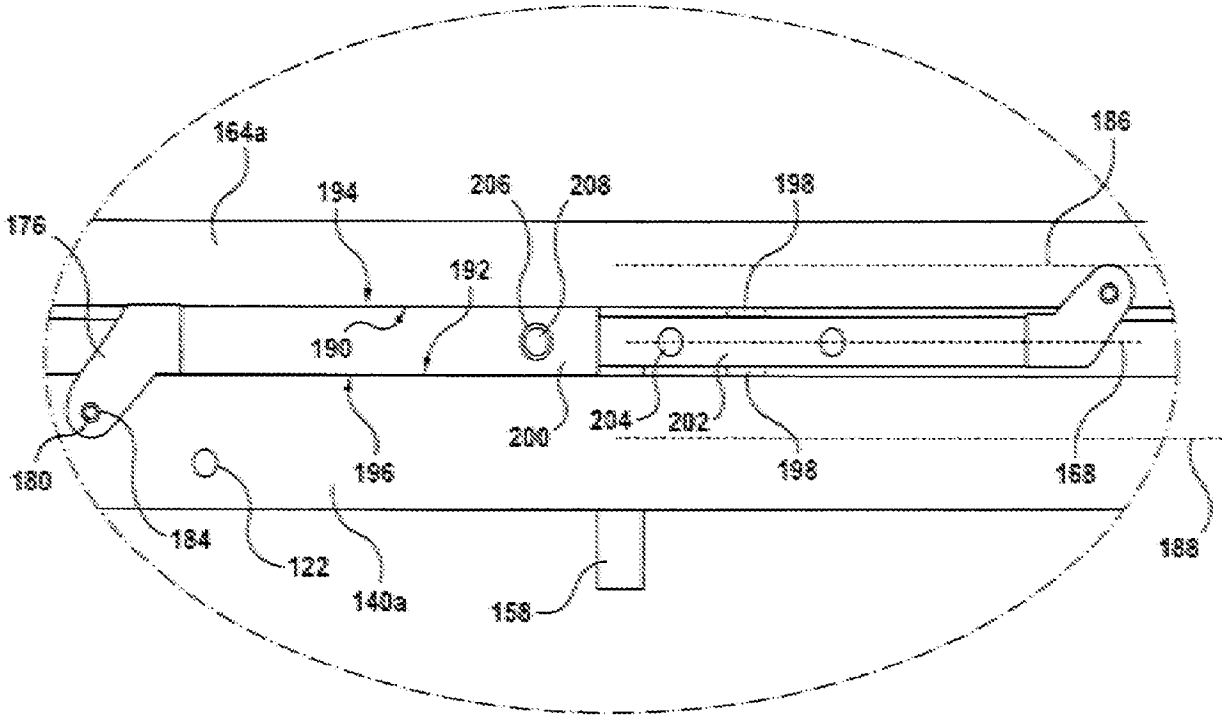

Referring to FIGS. 2*a*, 4*a* and 4*b*, in the illustrated example, three support arms 106*a* are used to pivotally connect the outboard base rail 140*a* and the outboard lifting rail 164*a*. The support arms 106 are generally identical elongate members, and each defines a corresponding support strut axis 168. Each support arm 106*a* is positioned vertically between the opposing rails 140*a*, 164*a* and has a lower end 170 that is pivotally connected to the base rail 140*a* and an upper end 172 that is pivotally connected to the lifting rail 164*a*. The pivotable connections between the ends 170, 172 of the support arms 106 and the rails 140*a*, 164*a* include flanges 176 that are connected to the upper and lower ends of the support arms 106*a*. U-shaped seats 178 defined between opposing flanges 176 on the upper and lower ends of the support arms 106*a* can be sized to receive the lifting and base rails 164*a*, 140*a*, respectively (see FIG. 7). The flanges 176 include matching apertures 180 that are aligned with a bushing 182 on the lifting and base rails 164*a*, 140*a* and secured to the rails using a pin 184.

Referring to FIG. 2*a*, when the boat support platform 104 is in the raised configuration the support arms 106*a* are arranged in a generally vertical position. In this configuration the support strut axes 168 are generally parallel to each other, and are generally perpendicular to a lifting beam axis 186 and a base beam axis 188. Each support arm 106*a* has a first surface 190, facing the first end 114 of the lift 100 when the support arm 106*a* is vertical, and an opposing second surface 192, facing the second end 116 of the lift 100 when the support arm 106*a* is vertical.

Referring now to FIGS. 4*a* and 4*b*, when the boat support platform 104 is pivoted into the lowered configuration, the lifting rail 164*a*, support arms 106*a* and base rail 140*a* are aligned with each other and are in a stacked formation, in which the support strut axes 168 are co-axial with each other, and are parallel to both the lifting rail and base rail axes 186, 188. In this configuration, the support arms 106*a* are parallel to both the lifting rail 164*a* and the base rail 140*a*, the first surface 190 of each support arm is facing a downward facing bottom surface 194 of the lifting rail 164*a*, and the second surface 192 of each support arm is facing an upward facing upper surface 196 of the base rail 140*a*. Optionally, the support arms 106*a* can be shaped so that when the boat support platform 104 is in the lowered position, the bottom surface 194 of the lifting rail 164*a* rests on and bears against at least a portion of the first surfaces 190 of the supporting arms 106*a*, and at least a portion of the second surfaces 192 of the support arms 106*a* rest on and bear against the upper surface 196 of the base rail 140*a*. Alternatively, the support arms 106*a* can be configured so that a gap remains between i) the bottom surface 194 of the lifting rail 164*a* and the first surfaces 190 of the support arms 106*a*, and/or ii) the second surfaces 192 of the support arms 106 and the upper surface 196 of the base beam 140*a*.

Optionally, one or more of the lifting rail 164*a*, base rail 140*a* and support arms 106 can include a spacer 198 that can be positioned between the opposing surfaces 190-194 and/or 192-196 when boat support platform 104 is lowered. The spacers can be any suitable member that can withstand the expected loads transferred from the boat support platform 104 to the base 102, and can withstand being used underwater. In the illustrated example, spacers 198 can optionally be provided toward the upper end 172 of the support arms 106*a* to account for small size differences between the tubular members used to form variable length support arms 106, as explained in greater detail below. Optionally, the spacers can be resilient or otherwise deformable to provide cushioning between the rails and the support arms. Examples of suitable spacers include, rubber pads, raised portions of the surfaces themselves (such as bosses) and metal spacers (such as aluminum plates or washers).

Optionally, the struts 100 can be of adjustable length to allow a user to vary the lifting height of the boat support platform 104, relative to the support surface 109. Referring to FIGS. 2*a*, 4*a* and 4*b*, in the illustrated example, the support arms 106*a* and 106*b* in each strut 101 are telescopically adjustable. Support arm 106*a* includes a boom member 200, pivotally connected to the base rail 140*a*, and an extension member 202 telescopically received in the boom 200, and pivotally connected to the lifting rail 164*a*. The extension member 202 includes a plurality of holes 204 spaced along its length, and can be secured in a desired position relative to a corresponding hole 206 in the boom member 200 using a locking pin 208. Optionally, a common locking pin can extend between both support arms 106*a* and 106*b* in each strut 101 to lock both support arms 106*a*, 106*b* in their desired extension positions. Alternatively, one or more locking pins can be used to secure each support arm 106*a*, 106*b*.

Figure 2B:
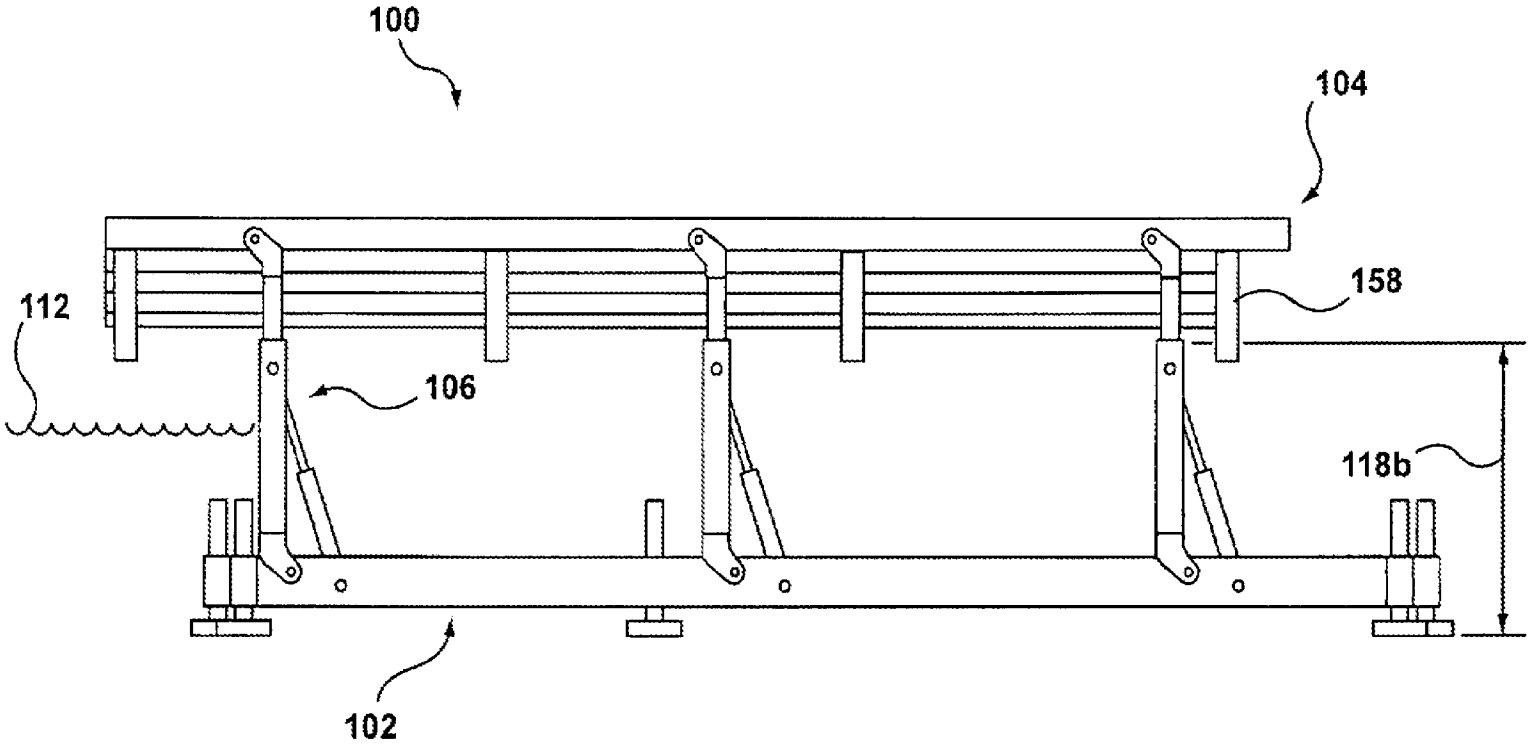
Figure 4C:
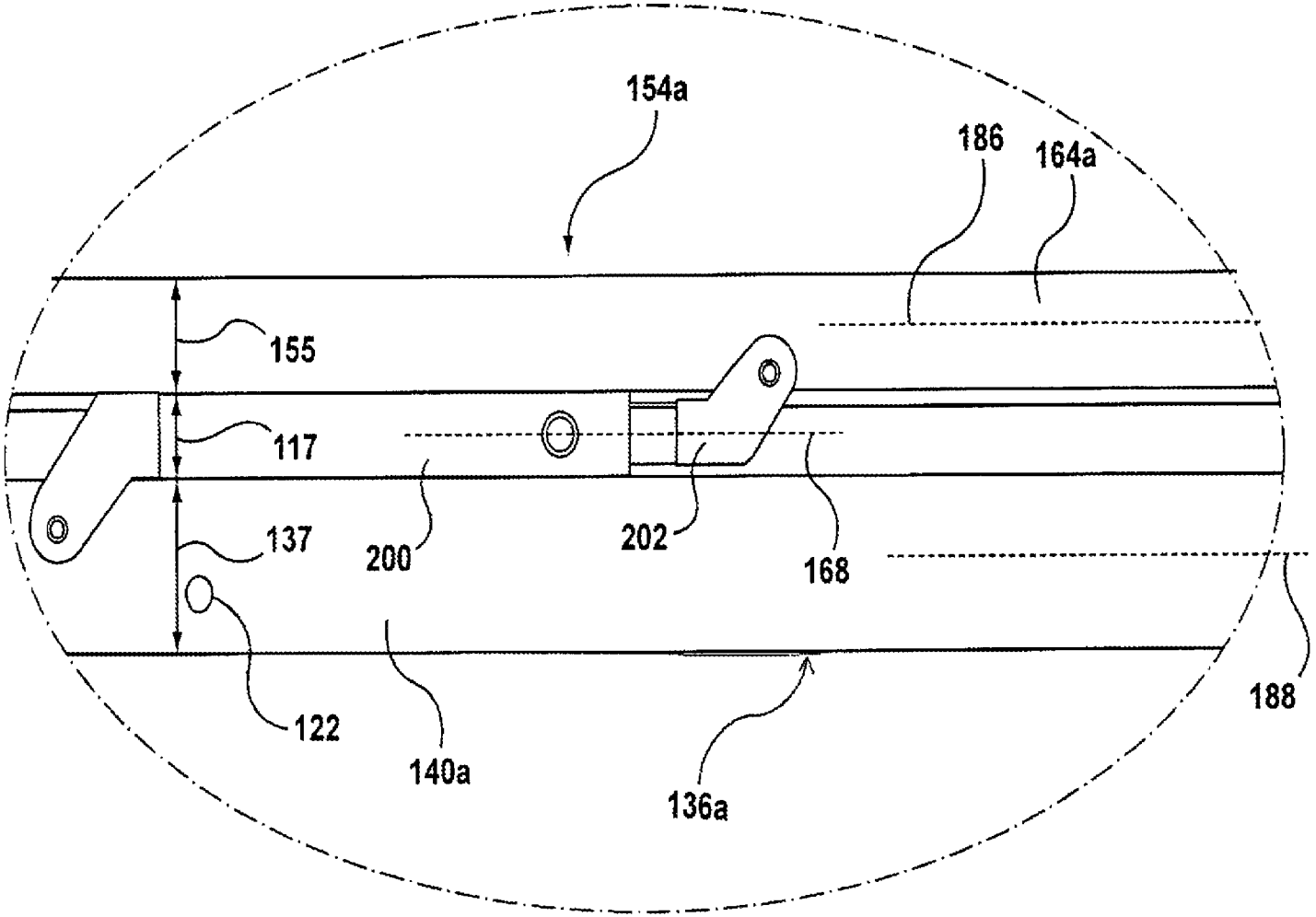

Still referring to FIGS. 2*a*, 4*a*, 4*b* and 5, when the telescopic support arms 106 are in an extended configuration, the boat support platform 104 is raised to an extended raised height 118*a* (FIG. 5). The extended raised height 118*a* may be in the range of, for example about 60 inches to about 100 inches, or more be greater than 100 inches. In the example illustrated, the extended raised position is approximately ninety-four inches. Referring to FIGS. 2*b* and 4*c*, when the telescopic support arms 106 are in a retracted position, the boat support platform 104 is lifted to a retracted raised height 118*b*. The retracted raised height 118*b* is lower than the extended raised height 118*a*, and maybe in the range of for example, about 48 inches to about 72 inches, or may be greater than 72 inches. In the example illustrated, the retracted raised height 118*b* is approximately 60 inches.

Referring to FIGS. 4*b* and 4*c*, when the boat support platform 104 is in the lowered position, in which the lifting rail 164*a*, support legs 106*a* and base beam 140*a* are in the stacked configuration, the lowered height 119 of the boat lift 100 remains the same, regardless of the magnitude of the raised height 118*a*, 118*b*. The lowered height 119 can be in the range of, for example, of about 5 inches to about 15 inches, or may be lower than 5 inches or greater than 15 inches. In the illustrated example the lowered height 119 is approximately seven inches.

Optionally, the support arms 106*a* can be secured in a plurality of intermediate extension positions, so that the lift ratio of the boat lift 100, the ratio of the raised height 118*a* or 118*b* to the lowered higher 119 can be in the range of, for example, about 8:1 to about 14:1, or can be greater than 14:1. In the illustrated example, when the support arms 106 are in their extended configuration, the lift ratio (i.e. ratio of extended raised height 118*a*: lowered height 119) is approximately 13.4:1. When the support arms 106 are in their contracted configuration, the lift ratio (retracted raised height 118*b*: lowered height 119) is approximately 8.5:1.

Referring to FIGS. 4*a* and 4*c*, when the boat support platform 104 is in the lowered position, the distance between the support surfaces 109 and an uppermost surface 122 of the boat support platform 104 defines a lift clearance 120. In the example illustrated, the lift clearance 120 is generally equal to the distance the boat lift 100 extends above the bottom of the lake. When the boat lift 100 is used in bodies of water that can freeze over during the winter, providing a relatively small lift clearance 120 may allow the boat lift 100 to be left submerged in relatively shallow water (for example close to shore) over the course of the winter without being crushed or otherwise damaged by the winter ice that forms on the surface of the water. When in the stacked configuration, in the illustrated example, the sum of the thickness 155 of the lifting beam 154*a*, the thickness 117 of the support legs 106 and the thickness 137 of the base beam 136*a* comprises a majority of the lift clearance 120, regardless of the degree of extension of the support struts 101. In this configuration, the lift clearance 120 is in the range of, for example, about 100% to about 150% of the sum of the thicknesses 155, 117 and 137, and optionally can be approximately 125% of the sum. In the illustrated example, the lift clearance 120 is approximately twenty four inches, and the thickness of the lifting beam 154*a* is approximately five inches, the thickness 117 of the support legs 106 is approximately five inches and the thickness of the base beam 136*a* is approximately nine inches. In this example the lift clearance 120 (twenty-four inches) is approximately 125% of the sum (nineteen inches) of the thicknesses 155, 117 and 137.

The lifting capacity of the boat lift 100 can vary based on the extension of the support arms 106, the power of actuators 124 and the materials used to construction the lift. In the illustrated example, when the support struts 101 are in the retracted position, the lifting capacity of the lift 100 can be up to between approximately 20,000 and 25,000 pound, and may be greater than 25,000 pounds. When the support struts 101 are in the extended position the lifting capacity can be up to between approximately 10,000 and 16,000 pounds, and may be greater than 16,000 pounds. Modifying the number of support struts 101 used in the lift 100, and the number of actuators 124 can also affect the lifting capacity of the lift 100. For example, a lift 100 equipped with only four support struts 101 and four actuators 124 may have a lifting capacity of up to between approximately 10,000 and 16,000 pounds (taking into account a variety of support arm 106 extension positions). Alternatively, for example, a lift 100 equipped with eight support struts 101 and eight actuators 124 may have a lifting capacity of up to 30,000 pounds or more.

Referring to FIGS. 2*a* and 7, the actuators 124 include respective piston rods 218 that are slidably mounted in corresponding cylinders 220. The lower end of each cylinder 220 is pivotably connected between the inboard and outboard base rails 138, 140 with a pin joint 222. The pin joint 222 includes a bushing 226 welded into the base rails 138, 140 (see also FIG. 8) and a pin 228 that extends between the rails 138, 140 and through a bushing 230 on the cylinder 220.

The outer diameter 224 of the cylinders 220 is selected so that it is less than the lateral spacing 144 (FIG. 6) between the inboard and outboard base rails 138,140. The cylinders 220 can fit between the rails 138, 140 and can pivot relative to the rails 138, 140 when the boat support platform 104 is moved between the lowered and raised positions. Optionally, portions of the inboard and outboard 138, 140 rails surrounding where the cylinder connects to the rails can be reinforced, for example by providing reinforcement plates, to help withstand the forces exerted by the cylinder. Portions of the support arms 106 connected to the upper end of the piston rods 218 can be similarly reinforced.

Optionally, referring again to FIG. 2*a*, the mounting flanges 176 connected to the upper and lower ends 172, 170 of the support arms 106*a* are shaped so that when the boat support platform 104 is raised, the pivot connections between the support arms 106*a* and the lifting rail 164*a* lie in a first plane 232, and pivot connections between the support arms 106*a* and the base rail 140*a* lie in a different plane 234. Plane 234 is longitudinally offset from the first plane 232. Planes 232 and 234 are located on opposite sides of axes 168. Preferably, the support arms 106*a* are connected so plane 234 is located closer to the second end 116 of the boat lift 100 than plane 232. In this configuration, when the boat support platform 104 is in the raised it is in an "over centre" position.

In the example illustrated, the lifting beams 154*a*,154*b* are parallel to the base beams 136*a*, 136*b* when the lift 100 is in and moves between the raised and lowered positions. This can help to maintain the boat (supported on the boat support platform 104) in a generally level position.

Referring to FIGS. 5 and 9, each cradle support 158 is a generally U-shaped member having a recessed central portion 236 that is at a lower elevation than the ends 237. In the illustrated example, the ends 237 are bolted to the inboard lifting rails 162*a*, 162*b*. The central portion 236 includes an upper, lift in surface 238 that faces, and underlies the hull of the boat on the lift. When a boat is moved onto the lift, it passes over the lift in surface 238. In this configuration, when the lifting platform 104 is in the lowered position, the central portions 236 of cradle supports 158 extend below the upper surface 196 of the base beams 136*a*, 136*b*, and the lift in surface 238 of the central portion 236 of the cradle support 158 is positioned between the upper 196 and lower 240 surfaces of the base beams 136*a*, 136*b* and a lower surface 242 of the cradle support can be positioned below the lower surface 240. Optionally, the cradle supports 158 can be configured so that when the boat support platform 104 is in the lowered positions, the lift in surfaces 238 are at a lower elevation than the pivot connections between the actuators 124 and the base beams 136*a*, 136*b*.

For the purposes of this description, the lift-in height 119 of the boat lift 100 is the elevation of the lift in surfaces 238 of the cradle supports 158 above the bottom of the lake or ocean (which is equivalent to the elevation above the support surfaces 109 of the feet 103, which are resting on the bottom) in which the lift 100 is being used. Providing a lower lift-in height may enable the boat lift 100 to be positioned in shallower water while still allowing a desired draft clearance 248 between the surface 112 and the cradle supports 158. The lift-in height 119 can be in the range of, for example, about four inches to about twenty inches. In the illustrated example, the lift-in height 119 is about seven inches.

Optionally, a plurality of longitudinal braces 250 can be connected between adjacent cradle supports 158. The braces 250 may help strengthen the boat support platform 104 and maintain the longitudinal spacing between cradle supports 158. The longitudinal braces 250 are, in the example illustrated, detachably bolted to cradle supports 158. This can facilitate transport of the boat lift 100.

Referring again to FIG. 5, the bunk assemblies 160 on the boat support platform 104 include a bunk cushion 252 that is supported by an extruded aluminum bunk beam 254. A mounting bracket 256 connects the each bunk beam to each of the cradle supports 158. Providing a plurality of mounting brackets 256 along the length of the bunk beam may help limit deflection of the bunk beam 254 when a boat is supported on the lift 100. Optionally, the mounting brackets 256 can be movably connected to the cradle supports 158 so the lateral position of the bunk assemblies 160 can be adjusted to accommodate different boat hull designs. The number and configuration of the bunk assemblies 160 provided on the boat support platform can be selected based on the hull design of the boat that is to be supported on the platform.

Optionally, the bunk beams 254 can be pivotally connected to the mounting brackets 256 so that the bunk assemblies 160 can pivot, in the direction indicated using arrow 257 (FIG. 3). Providing pivotable bunk assemblies may help to accommodate different shaped boat hulls.

In the illustrated example, the lifting beams 154*a*, 154*b* and base beams 136*a*, 136*b* are laterally spaced apart so that they are outboard of the boat 162 supported on the lift. Optionally, the lateral spacing between the inboard lifting rails 162*a*, 162*b* can be selected to be between one hundred and one hundred fifty percent of the boat width. Alternatively, in some examples, the configuration of the bunk assemblies 160 may allow a portion of the hull to overhang the lifting beams 154*a*, 154*b* when the boat is resting on the bunks 160. In such instances, the lateral spacing between the inboard lifting rails 162*a*, 162*b* can be selected to be between approximately seventy five and one hundred percent of the boat width.

The example illustrated includes six actuators 124, with one actuator associated with strut 101. Alternatively, the boat lift 100 can be configured to include a different number of actuators 124, and need not have one actuator associated with each strut 101. For example, each strut 101 can be connected to two or more separate actuator 124, or only a portion of the support struts 101 can be driven by actuators 124.

In the illustrated example, the structural members the boat lift, including, for example, rails 138*a*, 138*b*, 140*a*, 140*b*, 162*a*, 162*b*, and 164*a*, 164*b*, cradle supports 158, support legs 106 and bunk beams 254 are formed from aluminum. The use of aluminum may be preferable because aluminum is relatively light weight and is relatively corrosion resistant when placed in water, compared to an equivalent steel structure. Alternatively, some or all of the members in the boat lift 100 could be formed from other metals having sufficient mechanical properties, such as steel or titanium.

In the illustrated embodiment, each rail 138*a*, 138*b*, 140*a*, 140*b*, 162*a*, 162*b*, and 164*a*, 164*b*, is formed from a continuous, extruded tubular member having a generally rectangular cross sectional shape and a hollow interior (see FIGS. 7 and 9). Alternatively, the rails, and other structural members, can be formed from separate plates that are assembled together to form a tubular structure, an I-beam, a C-channel or other suitable structural member that can be used in place of an extruded rail.

Figure 10:
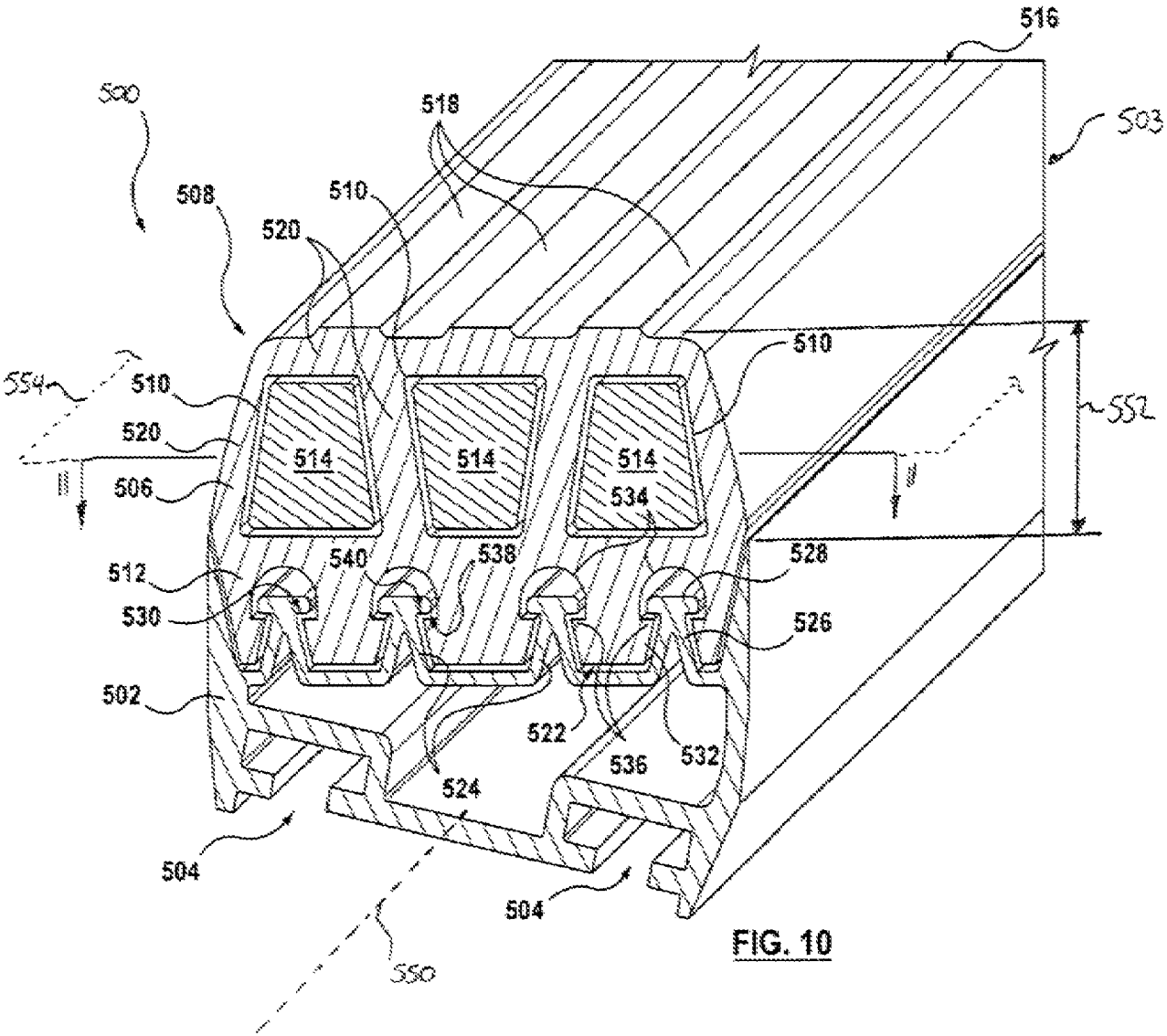
FIG. 10 is a section view of a bunk assembly for use on the boat lift of FIG. 1.
Figure 11:
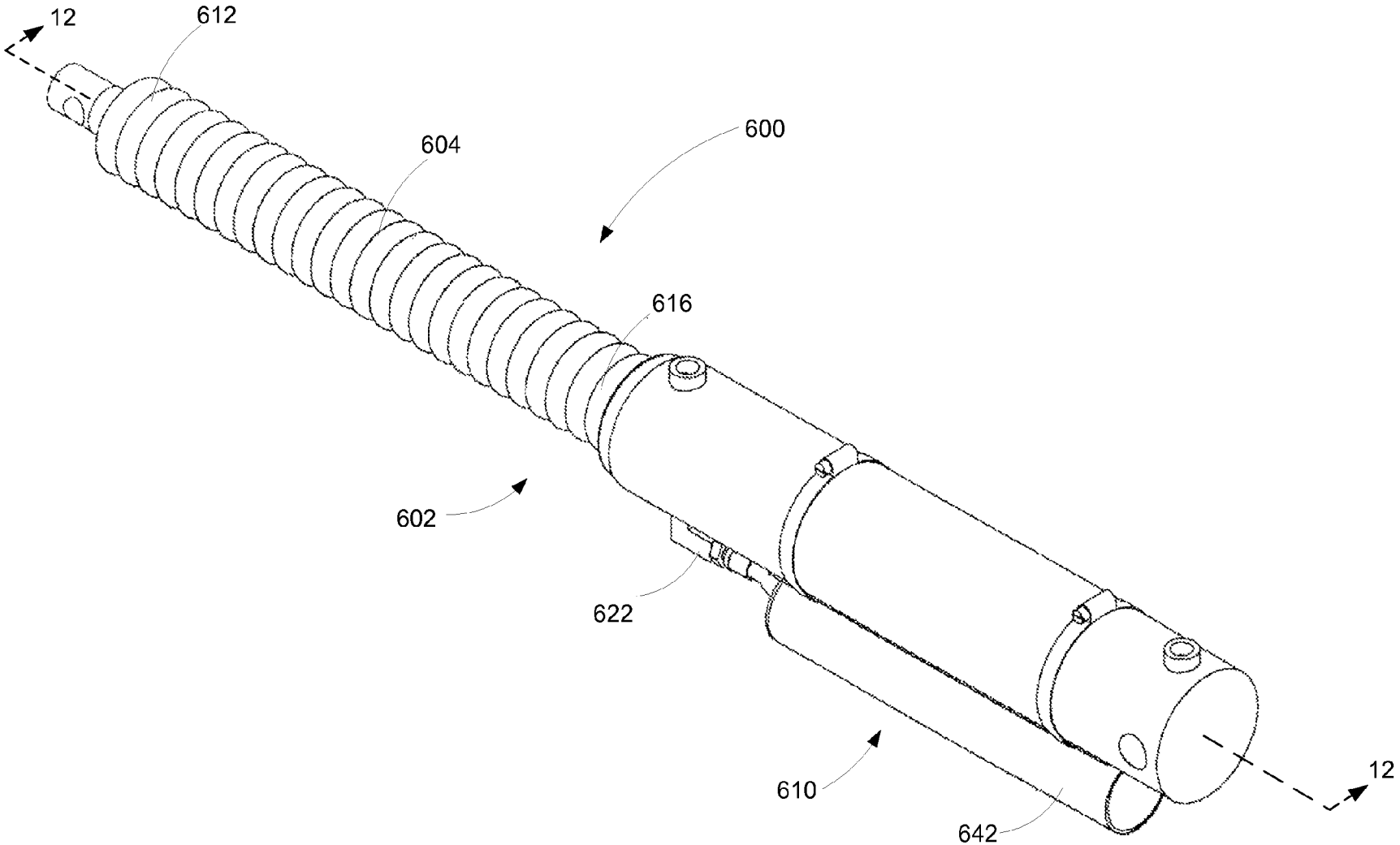
FIG. 11 is a perspective view of an actuator for use on the boat lift of FIG. 1 in an extended position.

Referring to FIG. 10, a cross sectional view of an example of a bunk assembly 500 that can be used on the boat lift 100 is illustrated. In this example, the bunk beam 502 comprises an extruded aluminum member of constant cross section. The bunk beam 502 includes a pair of T-shaped mounting slots 504 to receive the head of a mounting bolt (not shown) that is used to connected the bunk beam to the mounting brackets, such as mounting brackets 256. The bunk cushion 506 is an extruded member of constant cross section that is configured to connect to and be supported by the bunk beam 502.

When subjected to the weight of a boat lifted out of the water, the applicant noticed that known vinyl bunk cushions used on traditional boat lifts tend to have undesirable cushioning characteristics (i.e. the vinyl cushions tend to not compress sufficiently or tend to collapse too much), and have limited recovery characteristics (i.e. once crushed, a vinyl bunk cushion may tend to remain crushed). Other known bunk assembly designs, such as covering wood beams with carpet or other such coatings, also tend to have undesirable cushioning and recovery characteristics.

In the illustrated example the bunk cushion 506 has an upper portion 508, that is formed from a resilient material and includes three, longitudinal cavities 510. The bunk cushion 506 also includes a connecting portion 512 that is configured to connect to the bunk beam 502. The upper portion 508 is a relatively thin-walled structure and the cavities 510 are filled with inserts 514 formed from a second, resilient material that has a different durometer than the material used to form the upper portion 508. Optionally, the cavities 510 can have an identical cross sectional shape (although the central cavity can be inverted relative to the outer cavities) so that inserts 514 having a common cross sectional shape can be used to fill each cavity 510. The outer surface 516 of the upper portion 510 includes three ribs 518 that project above the outer surface 516 to contact the hull of the boat.

In the illustrated example, the resilient material used to form the upper portion 508 is an ethylene propylene diene monomer (EPDM) rubber and the insert 514 material is an EPDM closed cell foam. The EPDM foam is relatively less stiff than the EPDM rubber. EPDM rubber and EPDM closed cell foam were selected because they provide desired cushioning and recovery characteristics, as EPDM-based materials can resiliently flex when loaded. The relatively thin walls 520 of the upper portion 508 of the bunk cushion 506 can be sized to provide a desired degree of stiffness, and to deflect after a threshold load has been reached. As the walls 520 deflect, the foam inserts 514 are compressed. Compressing the inserts 514 may provide an additional resistive force, until the cushion 506 reaches an equilibrium position. The bunk cushion 506 may provide a varying, and optionally increasing, level of resistance as it is loaded until the cushion 506 reaches the equilibrium position, for example when the boat initially settles onto the bunk cushions 506. Applicant also noted that the loading of the bunk assemblies on a boat lift can vary along their length, based on the shaped of the boat and its weight distribution. Because the loading on the bunk cushion can vary along its length, different sections of the cushion 506 may experience different amounts of deflection.

Optionally, the stiffness of the bunk cushion 506 can be selected so that the equilibrium compression position (for a rated carrying capacity) is achieved before the inserts 514 are fully compressed. In this configuration, the inserts 514 can further compress and provide increased resistance if the load exerted on the bunk 500 fluctuates or temporarily increases, for example if the boat is jostled while on the lift 100 (for example as a result of wave or wind buffeting on the lift or boat). Providing a varying level of resistance in response to different loading conditions, may help enable the bunk cushion 506 to act as a resilient suspension member that can gently adapt to changes in loading and may help reduce the stress exerted by the cushion 506 on the hull of the boat.

This bunk cushion 506 may also be used on other types of boat supporting equipment, including, for example, boat trailers and boat transport railcars or shipping containers. Providing the resiliently deformable bunk cushion 506 on such equipment may act as a suspension system to support the boat above the bunk beams 502 and may help reduce the stress exerted on the boat hull.

In the illustrated example, the bunk beam 502 includes a plurality longitudinal grooves 522 separated by cushion retaining members 524. Each retaining member 524 includes a riser 526 extending from the bunk beam and a head 528 positioned at the distal end of the riser 526. The head 528 extends laterally beyond the edges of the riser 526 and forms retaining shoulders 530 for engaging the cushion 506.

The connecting portion 512 of the bunk cushion 506 includes a plurality of locking tabs 532. The tabs 532 can be sized and shaped to fit within the longitudinal grooves 522. A plurality of longitudinal cushion slots 534 can be configured to receive the heads 528 of the retaining members. The locking tabs 532 include locking barbs 536 that extend laterally away from the locking tabs 532 and are sized to be slightly wider than the spacing between adjacent retaining heads 528.

To assemble the bunk assembly 500, in the example illustrated, the bunk cushion 506 is placed on the bunk beam 502 so that the locking tabs 532 of the bunk cushion 506 are aligned with corresponding ones of the grooves 522 in the bunk beam 502, and then compressed against the bunk beam 502 until the barbs 536 laterally compress and the locking tabs 532 are forced into the grooves 522 in a snap-fit manner. After passing between the retaining heads 528, the locking barbs 536 can return to their original width. When the barbs 536 expand, an upward facing bearing surface 538 on the barbs 536 bears against a downward facing surface 540 of the retaining shoulder 530 to retain the tabs 532 within the grooves 522.

Optionally, some or all of the hollow structural members on the boat lift 100, including, for example the base rails 138*a*, 138*b*, 140*a*,140*b*, the lifting rails 162*a*, 162*b*, 164*a*, 164*b*, and the cradle supports 158, can include internal chambers that can be filled with a gas, for example air, that is less dense than water. When the internal chambers are filled with the gas and submerged in water, the chambers will exert an upward force that can help lift the boat support platform 104 from the lowered position, and optionally can be used to help float the entire boat lift 100 above the bottom of the body of water.

Figure 8:
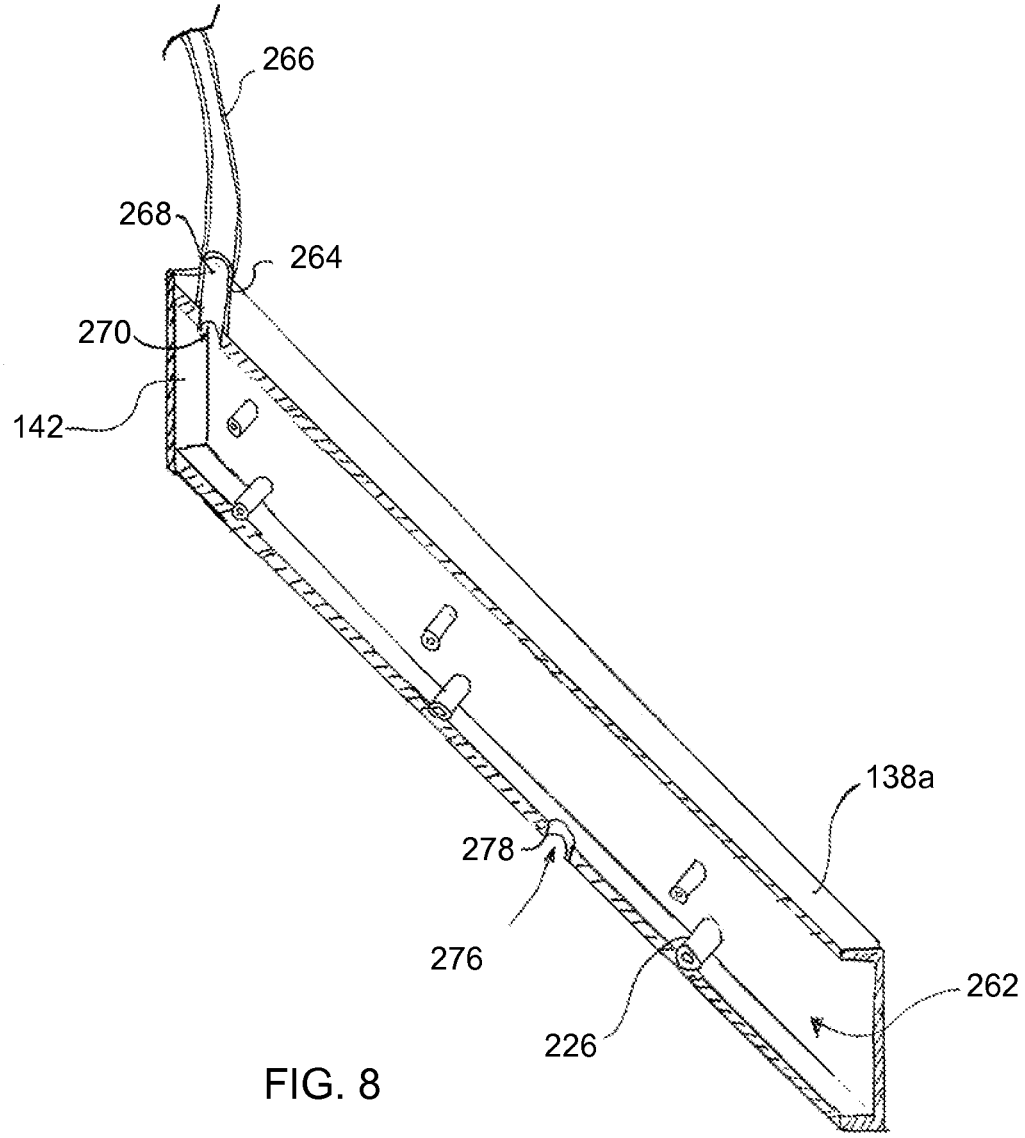
FIG. 8 is a section view of the base beam portion of FIG. 6 taken along line 8-8.

Referring to FIGS. 6-8, in the illustrated example, the hollow interiors of the inboard and outboard base rails 138*a*, 140*a* are configured to provide air-trapping chambers 262. The ends of the rails are capped with end plates 142 that are welded to the rails 138*a*, 140*a*, and any openings in the sidewalls of the rails, such as bushings 226 for connecting to the hydraulic cylinders 220, can be sealed using suitable means, including, for example welding the bushings 226 to the sidewalls of the rails 138*a*, 140*a*, or using a gasket to seal around the outer perimeter of the bushing. Optionally, the air-trapping chambers 262 in each rail 138*a*, 140*a* can be communicably linked using hollow cross members. Alternatively, each rail 138*a*, 140*a* can form a separate air-trapping chamber 262.

Each rail 138*a*, 140*a* includes a gas fitting 264 that can be connected to an external gas supply, such as, for example, a gas compressor located in the utility box 132 (FIG. 1), using hoses 266. The gas fitting 264 includes a gas inlet 268 connected to the hose 266, and a gas outlet 270 in fluid communication with the air-trapping chamber 262. Optionally, the gas fitting 264 can include a flow control member, such as a valve, to control the flow of gas into and out of the air-trapping chamber 262. Alternatively, the gas control member can be located upstream from the gas inlet 268 of the fitting, and optionally can be provided at the outlet of the gas compressor or other location that is above the surface of the water, for easier user access.

By manipulating the gas control member and/or the gas compressor, the user can selectably transfer air into the air-trapping chamber 262, to increase the upward force generated by the chamber 262, or release air from the air-trapping chamber 262 to reduce the upward force generated by the air-trapping chamber 262.

In the illustrated example, each air-trapping chamber 262 also includes a water passage 276 formed in a downward facing surface of the rails 138*a*, 140*a* that provides fluid communication between the interior of the air-trapping chambers 262 and the surrounding water. Each water passage 276 includes an first end 278 in communication with the surrounding water, and a second end 280 in fluid communication with the air-trapping chamber 262. As pressurized air is pumped into the air-trapping chambers 262 through the fittings 264 in the upper surfaces of the rails 138*a*, 140*a*, it can displace any water contained within the air-trapping chambers 262 and cause the water to flow out of the air-trapping chambers 262, through the water passage 276, and into the surrounding water. When the gas fitting 264 is sealed, the air within the chambers 262 remains pressurized and exerts and upward lifting force on the boat lift 100. If the air pressure in the chamber 262 exceeds the surrounding water pressure, excess air may pass through the water passage 276 and bubble out of the chambers 262. The presence of visible bubbles may alert a user that the air-trapping chamber 262 is full of air.

When a user releases the air from the air-trapping chambers 262 (for example by opening the gas fitting 264 or using another type of relief valve) pressure from the surrounding water can urge water through the water passage 276 and into the air-trapping chambers 262, thereby displacing the air from within the air-trapping chambers 262. Displacing the air from within the air-trapping chambers 262 can reduce the upward lifting force generated by the air-trapping chambers 262. If lift 100 is configured to contain the pressurized air within the air-trapping chamber 262 (using the gas fitting 264 or optionally another valve member), the water passage 276 can remain open at all times, as the air pressure will keep water from flowing into the air-trapping chambers 262. Alternatively, the water passage 276 can include a valve or other flow control member to help control the flow of water into and out of the air-trapping chambers 262.

Similarly, referring to FIG. 9, the inboard and outboard lifting rails 162, 164 can be configured to provide boat platform air-trapping chambers 272. The lifting rails 162, 164 can also be equipped with gas fittings 264 to allow a user to transfer air into, and out of the boat platform air-trapping chambers 272. Increasing the amount of upward force generated by the boat platform air-trapping chambers 272 may help reduce the net weight of the boat support platform 104 when it is submerged in water, which may reduce the lifting force required from the actuators 124 to raise the platform 104 from the lowered position. Reducing the lifting force required to lift the boat support platform 104 from the lowered position may be desirable as it may help the actuators 124 rise from the position of least mechanical advantage, and may reduce stress on the pivot joints connecting the actuators to the base beams 136*a*, 136*b* and support arms 106.

Optionally, the cradle supports 158 may also be hollow members that define a sealable internal chamber for containing air, but do not include gas fittings for transferring air into and out of the chamber. In the illustrated example, the cradle supports 158 contain air when they are manufactured, and the ends 237 of the cradle supports 158 can be welded to mounting plates 274. Optionally, the interior of the cradle supports 158 can be sealed by using solid mounting plates 274. Alternatively, the mounting plates 274 may not seal the interior of the cradle supports 158, and when the platform 104 is assembled, the mounting plates 274 can be bolted to the inner lifting rails 162 using a sealing gasket 277. Using a gasket 277 can help trap air within the cradle supports 158 when the boat lift platform 104 is assembled. A similar connection technique can be used to connect the longitudinal braces 250 to the cradle supports 158, so that optionally the braces 250 can also retain a quantity of air within their hollow interior chambers. Alternatively, the cradle supports 158 and or longitudinal braces 250 can be equipped with gas fittings as described above. Chambers that do not include gas fittings, for example chambers that are completely sealed by welding need not include water passages 276, because air is not pumped into, and then released from such sealed chambers.

Optionally, a user can fill some or all of the air chambers 262, 272 in the boat lift with a quantity of air that is sufficient to generate an upward force that can assist lifting the entire boat lift 100 off the bottom of the body of water. In this configuration, the boat lift 100 may be neutrally buoyant, such that is suspended in the water, or positively buoyant, such that the lift floats at or near the surface of the water. With the boat lift 100 raised off the bottom, the user can reposition the lift on the bottom without requiring a crane or other such heavy lifting device. A user may wish to reposition the lift in response to changes in the water level in the body of water (i.e. if the water level is lower in the fall than it was in the spring), or to move the boat lift into water that is deep enough so that the lift can be sunk and stored (in its lowered position) beneath the ice for the winter.

Alternatively, the boat lift 100 may be configured so that with all of its chambers filled with air the boat lift 100 still sinks in the water, but the upward force generated by the air in the chambers 262, 272 effectively reduces the net weight of the boat lift 100 to a weight that can be manually lifted by one or more humans (for example approximately 500 pounds), without the need for a crane.

Optionally, the air-trapping chambers can include a separate liner or bladder member that is positioned inside the structural members, or other suitable gas containing device. Alternatively, instead of being inside the base beams 136*a*, 136*b* and lifting beams 154*a*, 154*b*, the air-trapping chambers can be external tanks or bladders that can be connected to the boat lift 100.

When an unprotected piston/cylinder type actuator, for example actuator 124, is submerged under water, the sliding seal between the piston rod and the cylinder can be exposed to the water and other contaminants, which may damage the seal. In marine environments minerals, algae and other marine life can coat the piston rod surface and may also cause damage to the seal. If the seal surrounding the piston rod is damaged, dirt, sand, water (possibly salt water), and other foreign material may be able to leak pass the damaged seal and contaminate the hydraulic fluid in the cylinder. Rod scraping mechanisms are an example of devices that are used to clean submerged piston rods, but typically they cannot completely scrap all the accumulated material on the piston rod.

Optionally an actuator protection apparatus can be used to insulate the piston rod and hydraulic seals from the surrounding water, and may help prevent seal damage and hydraulic fluid contamination. Optionally, the hydraulic actuators used in the boat lift can include the hydraulic protection system, which may help prolong the useful service life of the actuators.

Referring to FIGS. 11-14, an example of an actuator 600 including an actuator protection apparatus 602 is illustrated. The actuator 600 can be similar to actuator 124 described above, and is suitable for use with the boat lift 100. In the illustrated example, the actuator protection apparatus 602 includes a rubber boot 604 surrounding the piston rod 606 of a hydraulic actuator 600, forming an insulating chamber around the piston rod 606 for containing an insulating fluid. In the illustrated example the insulating chamber is the generally annular cavity 608 between the piston rod 606 and the boot 604. The actuator protection apparatus also includes a reservoir 610 in fluid communication with the insulating chamber. A quantity of insulating fluid is contained within the apparatus 602 and is transferred between the annular cavity 608 and the reservoir 610 when the actuator is moved. The cavity 608 and reservoir 610 can form a closed fluid circuit.

The boot 604 is an expandable bellows-type member that can move between an extended configuration (FIGS. 11 and 12) and a retracted configuration (FIGS. 13 and 14) with the piston rod 606. The distal end 612 of the boot 604 is coupled to the piston rod 606 to provide a static, water-tight seal 614 between the boot 604 and the surface of the piston rod 606. The proximate end 616 of the boot is coupled to the cylinder housing 618 of the actuator 600, to provide an annular, static water-tight seal 620 between the boot 604 and the cylinder housing 618. In this configuration, the annular cavity 608 is a sealed cavity that is separated from water surrounding the boot.

A fluid conduit 622 connects the cavity 608 to the reservoir 610. In the illustrated example, the fluid conduit 622 includes a passage 624 formed in the cylinder housing 618 and an external pipe 626. The passage 624 has a fluid inlet 628 in communication with the cavity 608, and a fluid outlet 630 in a sidewall of the cylinder housing 618 that is connected to the inlet of the pipe 626 using a fitting 632. The outlet 634 of the pipe 626 is coupled to the reservoir 610 using an outlet fitting 636 (FIG. 14).

In the illustrated example, the reservoir 610 includes a resilient, expandable bladder 638 formed from a corrugated rubber tube 640. One end of the tube is connected to the pipe outlet fitting and the other end of the tube is sealed to contain the insulating fluid in the bladder 638. The bladder 638 is elastically expandable from a contracted position (FIG. 12) to an extended position (FIG. 14).

Figure 14:
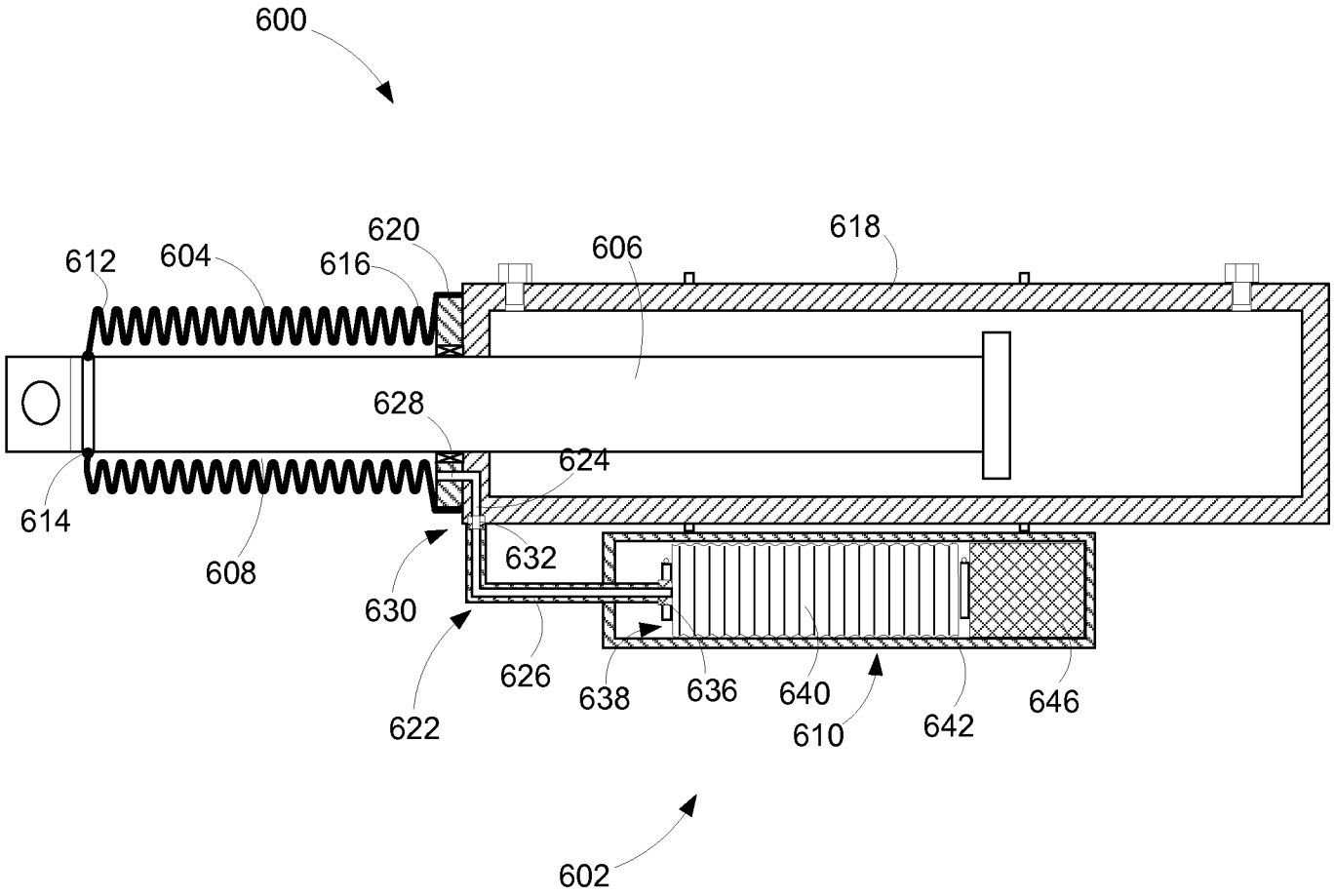
FIG. 14 is a section view of the actuator of FIG. 13, taken along line 14-14.

When the hydraulic actuator 600 is in use, the piston rod 606 is moved between its extended (FIG. 12) and contracted positions (FIG. 14). When the piston rod 606 is extended, the annular cavity 608 has a relatively large volume, and is filled with the insulating fluid. As the piston rod 606 moves toward its retracted position, the volume of the annular cavity 608 decreases, and insulating fluid is forced from the annular cavity 608 into the bladder 638. As the quantity of insulating fluid in the bladder 638 increases, the resilient bladder 638 expands to accommodate the incoming insulating fluid.

Figure 12:
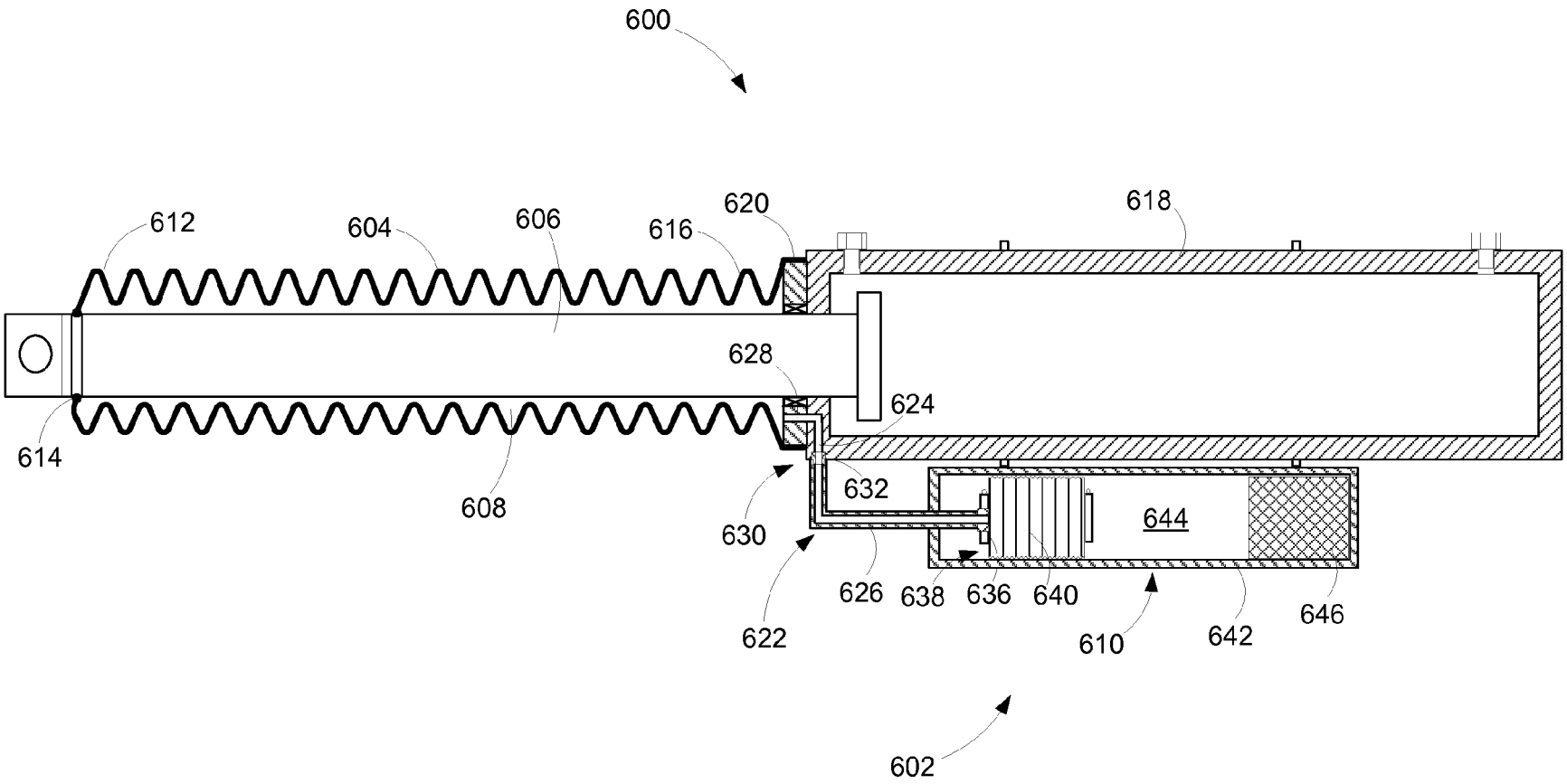
FIG. 12 is a section view of the actuator of FIG. 11, taken along line 12-12.
Figure 13:
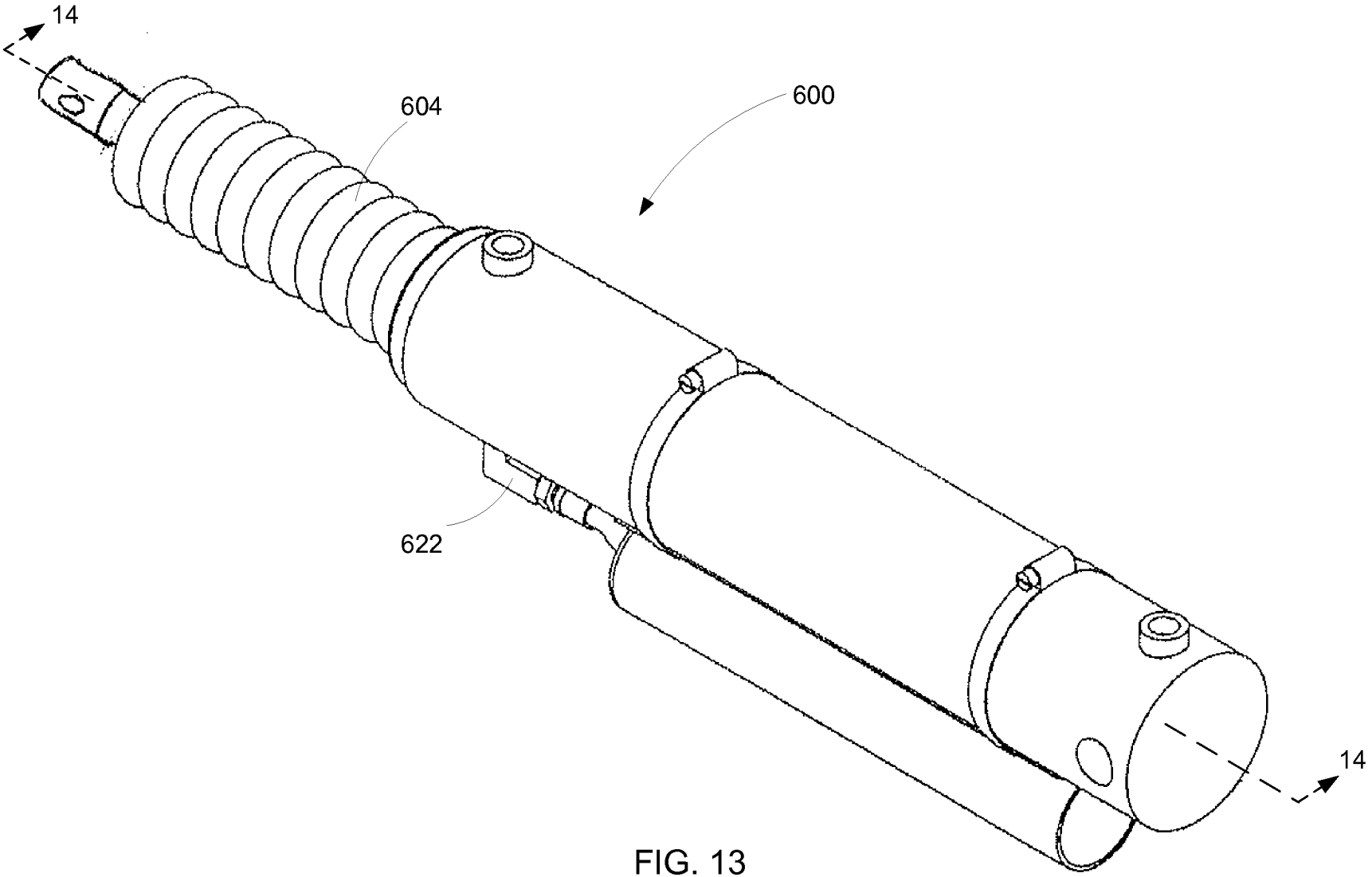
FIG. 13 is a perspective of the actuator of FIG. 11 in a retracted position.

When the piston rod is extended, the volume of the annular cavity 608 increases, which can slightly decrease the internal pressure of the cavity 608 and draw insulating fluid from the reservoir 610 into the cavity. In the illustrated example, the resilient nature of the rubber tube 640 may also exert a contractive force on the bladder 638, which can help urge the insulating fluid from the bladder 638 into the cavity 608. As the insulating fluid flows from the bladder 638 into the cavity 608, the bladder 638 can shrink to its contracted configuration (FIG. 12). Optionally, in some configurations, the suction from the extension of the piston rod 606 may be sufficient to draw the insulating fluid into the cavity 608, and the bladder 638 need not be resilient.

In the illustrated example, the reservoir 610 also includes a cylindrical outer shell 642 surrounding the bladder 638. The cylindrical outer shell 642 is connected to the cylinder housing 618. The outer shell has a hollow interior 644 that is large enough to accommodate the bladder 638 when the bladder 638 is extended. The outer shell 642 can be water tight, and the interior 644 of the outer shell can be filled with air. In this configuration, the bladder 638 can expand within the outer shell 642, without encountering resistance from the water surrounding the actuator 600. Expanding into the interior 644 of the outer shell 642 may also help prevent the bladder 638 from becoming jammed against the support arms 106 or other portions of the lift 100 as the bladder 638 expands. The outer shell 642 can be formed from a rigid material, including for example metal or plastic, to protect the bladder 638 from being impacted by debris in the water. In other embodiments, the bladder 638 can be exposed to the surrounding water, and need not be enclosed in an outer shell 642, and/or the interior 644 of the shell 642 can be open to the surrounding water.

The outer shell 642 can be sized so that when the bladder 638 is fully extended (i.e. when the piston rod 606 is contracted and the boat lift 100 is in the lowered position) the bladder 638 does not contact the end wall of the shell 642. This can allow for the bladder 638 to over-extend beyond its normal, fully extended position if the pressure of the insulation liquid within the system increases. Such a pressure increase may occur, for example, if some or all of the boot 604 extends above the surface of the water surrounding the boat lift 100. Optionally, a stopper 646 can be provided within the shell 642, to support the bladder 638 when it reaches its fully extended position while still allowing for over-extension of the bladder 638 if necessary. Preferably, the stopper 646 is a flexible member that is stiff enough to support the weight of the bladder 638 under normal operating conditions, but yieldable enough to compress and allow the bladder 638 to over-extend if needed. More preferably, the stopper 646 is a resilient member that can return the bladder 638 to its normal, fully extended position when the insulating fluid pressure decreases (for example when the boot 604 is re-submerged in the water). Examples of resilient stoppers 646 can include springs, air bladders, and other biasing elements. Optionally, the stopper 646 can be selected so that it provides a varying, increasing level of resistance in response to increasing extension of the bladder 638 (for example a coil spring having a selected stiffness co-efficient).

Optionally, the insulating fluid in the actuator protection apparatus 602 can be pressurized to an operating pressure that is generally equivalent to the hydrostatic pressure of the water surrounding the boot 604. Pressurizing the insulating fluid within the cavity 608 in this manner can reduce the differential pressure across the static seals 614 and 620, which may help reduce leakage across these seals. Optionally, the insulating fluid can be pressurized to a pressure that is above the hydrostatic pressure of the water, so that if any leakage does occur at the seals, insulating fluid will leak into the water, instead of allowing water to contaminate the insulating fluid. In the illustrated example, the insulating fluid contained in the actuator protection apparatus is filtered fresh water that is generally free from sand, salt and marine life. Filtered water may be a preferred insulating fluid for use with the boat lift 100, because it is unlikely to cause environmental damage if it leaks into the surrounding water. Optionally, instead of filtered water, the insulating fluid can be any other fluid that will not damage the actuator 600, including, for example, hydraulic oil, air, inert gases and other lubricants.

Optionally, the insulating fluid within the annular cavity 608 can be selected to have generally the same density as the surrounding water.

What has been described above has been intended to be illustrative of the invention and non-limiting and it will be understood by persons skilled in the art that other variants and modifications may be made without departing from the scope of the invention as defined in the claims appended hereto.

What has been described above has been intended to be illustrative of the invention and non-limiting and it will be understood by persons skilled in the art that other variants and modifications may be made without departing from the scope of the invention as defined in the claims appended hereto.

The invention claimed is:

1. A boat lift apparatus comprising: a) a base comprising a support surface to rest on the bottom of a body of water, a first base beam and a second base beam, the second base beam oriented generally parallel to and spaced laterally apart from the first base beam; b) a boat support platform comprising a first lifting beam aligned with the first base beam, a second lifting beam aligned with the second base beam, and at least one cradle support connected to and suspended between the first and second lifting beams, the at least one cradle support having at least a part maintained at a level below the level of the lifting beams for supporting a part of a boat below the level of the lifting beams, the boat support platform being moveable relative to the base between a lowered position for receiving the boat and a raised position for lifting the boat out of the water; c) at least two first support struts connecting the first base beam and the first lifting beam, each first support strut comprising a lower end pivotally connected to the first base beam and an opposing upper end pivotally connected to the first lifting beam; d) at least two second support struts connecting the second base beam and the second lifting beam, each second support strut comprising a lower end pivotally connected to the second base beam and an opposing upper end pivotally connected to the second lifting beam; and wherein when the boat support platform is in the lowered position the at least two first support struts are oriented generally parallel to both the first base beam and the first lifting beam, and the at least two second support struts are oriented generally parallel with both the second base beam and the second lifting beam, wherein with the boat support platform in the lowered position the first support struts overlie at least a portion of the first base beam and the first lifting beam overlies at least a portion of the first support struts.

2. The boat lift apparatus of claim 1, wherein the at least one cradle support comprises a lift in surface and, with the boat support platform in the lowered position the lift in surface is at a lowered height, and with the boat support platform in the raised position, the lift in surface is at a raised height, wherein a lift ratio between the raised height and the lowered height is greater than 8:1.

3. The boat lift apparatus of claim 2, wherein when the boat support platform is in the lowered position the lift in surface is less than 10 inches above the support surface.

4. The boat lift apparatus of claim 1, wherein when the boat support platform is in the lowered position, a lift clearance distance between an upper surface of the lifting beams and the support surface is between 100% and 150% of the sum of the thickness of one lifting beam, one support strut and one base beam.

5. The boat lift apparatus of claim 1, further comprising a plurality of bunk assemblies supported on the at least one cradle support and wherein at least a portion of the bunk assemblies are moveably connected to the at least one cradle support so that the lateral position of the at least some of the bunk assemblies is adjustable relative to the cradle support.

6. A boat lift apparatus comprising: a) a base comprising a support surface to rest on the bottom of a body of water, a first base beam and a second base beam, the second base beam oriented generally parallel to and spaced laterally apart from the first base beam; b) a boat support platform comprising a first lifting beam aligned with the first base beam, a second lifting beam aligned with the second base beam, and at least one cradle support connected to and suspended between the first and second lifting beams, the at least one cradle support having at least a part maintained at a level below the level of the lifting beams for supporting a part of a boat below the level of the lifting beams, the boat support platform being moveable relative to the base between a lowered position for receiving the boat and a raised position for lifting the boat out of the water; c) at least two first support struts connecting the first base beam and the first lifting beam, each first support strut comprising a lower end pivotally connected to the first base beam and an opposing upper end pivotally connected to the first lifting beam; d) at least two second support struts connecting the second base beam and the second lifting beam, each second support strut comprising a lower end pivotally connected to the second base beam and an opposing upper end pivotally connected to the second lifting beam; and wherein when the boat support platform is in the lowered position the at least two first support struts are oriented generally parallel to both the first base beam and the first lifting beam, and the at least two second support struts are oriented generally parallel with both the second base beam and the second lifting beam, wherein each of the first support struts comprises a first bearing surface and an opposing second bearing surface, and when the boat platform is in the lowered position a downward facing surface of the first lifting beam bears against each first bearing surface, and the second bearing surfaces bear against an upward facing surface on the first base beam.

7. A boat lift apparatus comprising: a) a base comprising a support surface to rest on the bottom of a body of water, a first base beam and a second base beam, the second base beam oriented generally parallel to and spaced laterally apart from the first base beam; b) a boat support platform comprising a first lifting beam aligned with the first base beam, a second lifting beam aligned with the second base beam, and at least one cradle support connected to and suspended between the first and second lifting beams, the at least one cradle support having at least a part maintained at a level below the level of the lifting beams for supporting a part of a boat below the level of the lifting beams, the boat support platform being moveable relative to the base between a lowered position for receiving the boat and a raised position for lifting the boat out of the water; c) at least two first support struts connecting the first base beam and the first lifting beam, each first support strut comprising a lower end pivotally connected to the first base beam and an opposing upper end pivotally connected to the first lifting beam; d) at least two second support struts connecting the second base beam and the second lifting beam, each second support strut comprising a lower end pivotally connected to the second base beam and an opposing upper end pivotally connected to the second lifting beam; and wherein when the boat support platform is in the lowered position the at least two first support struts are oriented generally parallel to both the first base beam and the first lifting beam, and the at least two second support struts are oriented generally parallel with both the second base beam and the second lifting beam, wherein each first support strut comprises a strut axis, and wherein when the boat support platform is in the lowered position the strut axes of the first support struts are coaxial with each other.

8. A boat lift apparatus comprising: a) a base comprising a support surface to rest on the bottom of a body of water, a first base beam and a second base beam, the second base beam oriented generally parallel to and spaced laterally apart from the first base beam; b) a boat support platform comprising a first lifting beam aligned with the first base beam, a second lifting beam aligned with the second base beam, and at least one cradle support connected to and suspended between the first and second lifting beams, the at least one cradle support having at least a part maintained at a level below the level of the lifting beams for supporting a part of a boat below the level of the lifting beams, the boat support platform being moveable relative to the base between a lowered position for receiving the boat and a raised position for lifting the boat out of the water; c) at least two first support struts connecting the first base beam and the first lifting beam, each first support strut comprising a lower end pivotally connected to the first base beam and an opposing upper end pivotally connected to the first lifting beam; d) at least two second support struts connecting the second base beam and the second lifting beam, each second support strut comprising a lower end pivotally connected to the second base beam and an opposing upper end pivotally connected to the second lifting beam; and wherein when the boat support platform is in the lowered position the at least two first support struts are oriented generally parallel to both the first base beam and the first lifting beam, and the at least two second support struts are oriented generally parallel with both the second base beam and the second lifting beam, further comprising a first actuator connected between at least one of the first support struts and the first base beam to pivot the at least one of the first support struts relative to the first base beam, and a second actuator connected between at least one of the second support struts and the second base beam to pivot the at least one of the second support struts relative to the second base beam.

9. The boat lift apparatus of claim 8, wherein the first base beam comprises an inboard base rail and an opposing outboard base rail, the outer base rail being laterally spaced apart from and generally parallel to the inner base rail, and wherein a first end of the first actuator is disposed between the inner and outer base rails and is pivotally connected to at least one of the inner and outer base rails.

10. The boat lift apparatus of claim 9, wherein the at least two first support struts comprise an inboard support arm pivotally connected to the inboard base rail, and an outboard support arm pivotally connected to the outboard base rail, the outboard support arm being generally parallel to the inboard support arm, and wherein a second end of the first actuator is disposed between, and is pivotally connected to at least one of the inboard and outboard support arms.

11. The boat lift apparatus of claim 8, wherein the first actuator and second actuator are positioned on opposite sides of the at least one cradle support, and are both outboard from the at least one cradle support.

12. A boat lift apparatus comprising: a) a base comprising a support surface to rest on the bottom of a body of water, a first base beam and a second base beam, the second base beam oriented generally parallel to and spaced laterally apart from the first base beam; b) a boat support platform comprising a first lifting beam aligned with the first base beam, a second lifting beam aligned with the second base beam, and at least one cradle support connected to and suspended between the first and second lifting beams, the at least one cradle support having at least a part maintained at a level below the level of the lifting beams for supporting a part of a boat below the level of the lifting beams, the boat support platform being moveable relative to the base between a lowered position for receiving the boat and a raised position for lifting the boat out of the water; c) at least two first support struts connecting the first base beam and the first lifting beam, each first support strut comprising a lower end pivotally connected to the first base beam and an opposing upper end pivotally connected to the first lifting beam; d) at least two second support struts connecting the second base beam and the second lifting beam, each second support strut comprising a lower end pivotally connected to the second base beam and an opposing upper end pivotally connected to the second lifting beam; and wherein when the boat support platform is in the lowered position the at least two first support struts are oriented generally parallel to both the first base beam and the first lifting beam, and the at least two second support struts are oriented generally parallel with both the second base beam and the second lifting beam, wherein the first lifting beam is parallel to the first base beam when the boat support platform is in the raised position, when the boat support platform is in the lowered position and when the boat support platform is in an intermediate position between the raised and lowered positions.

13. A boat lift apparatus comprising: a) a base comprising a support surface to rest on the bottom of a body of water, a first base beam and a second base beam, the second base beam oriented generally parallel to and spaced laterally apart from the first base beam; b) a boat support platform comprising a first lifting beam aligned with the first base beam, a second lifting beam aligned with the second base beam, and at least one cradle support connected to and suspended between the first and second lifting beams, the at least one cradle support having at least a part maintained at a level below the level of the lifting beams for supporting a part of a boat below the level of the lifting beams, the boat support platform being moveable relative to the base between a lowered position for receiving the boat and a raised position for lifting the boat out of the water; c) at least two first support struts connecting the first base beam and the first lifting beam, each first support strut comprising a lower end pivotally connected to the first base beam and an opposing upper end pivotally connected to the first lifting beam; d) at least two second support struts connecting the second base beam and the second lifting beam, each second support strut comprising a lower end pivotally connected to the second base beam and an opposing upper end pivotally connected to the second lifting beam; and wherein when the boat support platform is in the lowered position the at least two first support struts are oriented generally parallel to both the first base beam and the first lifting beam, and the at least two second support struts are oriented generally parallel with both the second base beam and the second lifting beam, wherein each of the first support arms and second support struts are of variable length and are securable in a retracted configuration and an extended configuration.

14. The boat lift apparatus of claim 13, wherein the lowered height of the boat support platform is the same when the first and second support arms are in either the retracted or extended configurations.

15. A boat lift apparatus comprising: a) a base comprising a support surface to rest on the bottom of a body of water, a first base beam and a second base beam, the second base beam oriented generally parallel to and spaced laterally apart from the first base beam; b) a boat support platform comprising a first lifting beam aligned with the first base beam, a second lifting beam aligned with the second base beam, and at least one cradle support connected to and suspended between the first and second lifting beams, the at least one cradle support having at least a part maintained at a level below the level of the lifting beams for supporting a part of a boat below the level of the lifting beams, the boat support platform being moveable relative to the base between a lowered position for receiving the boat and a raised position for lifting the boat out of the water; c) at least two first support struts connecting the first base beam and the first lifting beam, each first support strut comprising a lower end pivotally connected to the first base beam and an opposing upper end pivotally connected to the first lifting beam; d) at least two second support struts connecting the second base beam and the second lifting beam each second support strut comprising a lower end pivotally connected to the second base beam and an opposing upper end pivotally connected to the second lifting beam; and wherein when the boat support platform is in the lowered position the at least two first support struts are oriented generally parallel to both the first base beam and the first lifting beam, and the at least two second support struts are oriented generally parallel with both the second base beam and the second lifting beam, further comprising a plurality of support legs for supporting the base above the bottom of the body of water, the plurality of support legs comprising a plurality of first support legs connected to the first base beam, and a plurality of second support legs connected to the second base beam, wherein the plurality of first legs comprises at least one inboard support leg, positioned laterally between first base beam and the second base beam, and at least one outboard support leg, positioned outboard of the first base beam.

16. The boat lift of claim 15, wherein the at least one inboard support leg at least partially underlies the boat support platform.

17. The boat lift apparatus of claim 15, wherein the distance between an outboard surface of the first base beam and an outboard surface of the second base beam defines a base width, and the at least one outboard support leg is laterally spaced apart from an outboard surface of the first base beam by a leg offset distance that is less than 30% of the base width.

18. A boat lift apparatus comprising: a) a base comprising a support surface to rest on the bottom of a body of water, a first base beam and a second base beam, the second base beam oriented generally parallel to and spaced laterally apart from the first base beam; b) a boat support platform comprising a first lifting beam aligned with the first base beam, a second lifting beam aligned with the second base beam, and at least one cradle support connected to and suspended between the first and second lifting beams, the at least one cradle support having at least a part maintained at a level below the level of the lifting beams for supporting a part of a boat below the level of the lifting beams, the boat support platform being moveable relative to the base between a lowered position for receiving the boat and a raised position for lifting the boat out of the water; c) at least two first support struts connecting the first base beam and the first lifting beam, each first support strut comprising a lower end pivotally connected to the first base beam and an opposing upper end pivotally connected to the first lifting beam; d) at least two second support struts connecting the second base beam and the second lifting beam, each second support strut comprising a lower end pivotally connected to the second base beam and an opposing upper end pivotally connected to the second lifting beam; and wherein when the boat support platform is in the lowered position the at least two first support struts are oriented generally parallel to both the first base beam and the first lifting beam, and the at least two second support struts are oriented generally parallel with both the second base beam and the second lifting beam, wherein at least one of the base and the boat support platform further comprises a chamber for containing a gas that is less dense than water.

19. A boat lift apparatus comprising: a) a base configured to rest on the bottom of a body of water; b) a boat support movably connected to the base, the boat support being configured to support a boat and being movable between a lowered position, to receive a boat, and a raised position, to lift the boat out of the water; and wherein at least one of the base and the boat support includes a beam containing at least one first chamber for trapping a gas that is less dense than water so that gas trapped within the chamber exerts a lifting force with the at least one of the base and the boat support submerged under water, further comprising a flow control arrangement to control flow of the gas into and out of the at least one first chamber, the flow control arrangement including a first passage in a wall of the at least one first chamber for enabling flow of gas into the at least one chamber, the flow control arrangement further comprising a second passage in a downward facing wall of the at least one first chamber for enabling flow of water into and out of the chamber.

20. The boat lift apparatus of claim 19, wherein the base comprises a first base beam and a second base beam oriented generally parallel to and laterally spaced apart from the first base beam, and wherein the at least one first chamber comprises at least one chamber in each base beam.

21. The boat lift apparatus of claim 20, wherein the boat support comprises at least one second chamber for trapping a gas that is less dense than water.

22. The boat lift apparatus of claim 21, wherein the boat support comprises a first lifting beam oriented generally parallel to the first base beam and a second lifting beam oriented generally parallel to the second lifting beam, and wherein the at least one second chamber comprises at least one second chamber in each lifting beam.

23. The boat lift apparatus of claim 22, further comprising a plurality of cradle supports suspended between the first and second lifting beams, each cradle support having an internal chamber in fluid communication with the at least one second chamber in each lifting beam.

* * * * *